US009409097B2

(12) United States Patent
Comfort

(10) Patent No.: US 9,409,097 B2
(45) Date of Patent: Aug. 9, 2016

(54) ACCESSORIES TO A MODULAR PATHWAY APPARATUS

(71) Applicant: Q-BA-MAZE Inc., Minneapolis, MN (US)

(72) Inventor: Andrew Comfort, Minneapolis, MN (US)

(73) Assignee: Q-BA-MAZE Inc., Minneapolis, MN (US)

( * ) Notice: Subject to any disclaimer, the term of this patent is extended or adjusted under 35 U.S.C. 154(b) by 0 days.

(21) Appl. No.: 13/940,166

(22) Filed: Jul. 11, 2013

(65) Prior Publication Data

US 2014/0017970 A1 Jan. 16, 2014

Related U.S. Application Data

(60) Provisional application No. 61/670,370, filed on Jul. 11, 2012, provisional application No. 61/794,220, filed on Mar. 15, 2013.

(51) Int. Cl.

| | |
|---|---|
| ***A63H 29/08*** | (2006.01) |
| ***A63H 18/02*** | (2006.01) |
| ***A63F 7/36*** | (2006.01) |
| ***A63F 7/24*** | (2006.01) |

(52) U.S. Cl.

CPC ..... *A63H 18/02* (2013.01); *A63F 7/249* (2013.01); *A63F 7/3622* (2013.01); *A63F 2007/3607* (2013.01); *A63F 2007/3651* (2013.01); *A63F 2007/3662* (2013.01); *A63F 2250/18* (2013.01)

(58) Field of Classification Search

USPC ..... 446/89, 127, 128, 168, 169, 170, 173; 473/434–436; 273/109, 118 R, 120 R, 273/138.2, 342

See application file for complete search history.

(56) References Cited

U.S. PATENT DOCUMENTS

| | | | | |
|---|---|---|---|---|
| 1,334,954 | A * | 3/1920 | Jancek | 446/170 |
| 1,531,542 | A | 3/1925 | Cogshall | |
| 2,472,363 | A | 6/1949 | Blackinton | |
| 2,619,829 | A | 12/1952 | Tatum | |
| 2,662,336 | A | 12/1953 | Zalkind | |
| 2,886,909 | A * | 5/1959 | Hesse et al. | 40/409 |
| 2,998,673 | A * | 9/1961 | Rhodes | 446/168 |
| 3,028,704 | A | 4/1962 | Rumbaugh | |
| 3,034,254 | A | 5/1962 | Christensen | |
| 3,405,479 | A | 10/1968 | Paulson | |

(Continued)

FOREIGN PATENT DOCUMENTS

| | | |
|---|---|---|
| CH | 519346 | 2/1972 |
| DE | 19938848 | 7/2000 |

(Continued)

OTHER PUBLICATIONS http://www.nikitiki.co.jp/toymakers/13/images/cuboro elements all.gif, Mar. 9, 2006, 2 pgs.

(Continued)

*Primary Examiner* — Kurt Fernstrom

(74) *Attorney, Agent, or Firm* — Winthrop & Weinstine, P.A.

(57) ABSTRACT

An accessory, such as a trampoline, for a toy or game may include a base, a rebounding portion configured to rebound an impacting object, and an adjustment portion coupled to the base and the rebounding portion, supporting the rebounding portion relative to the base, and configured for at least two degrees of rotational freedom relative to the base.

10 Claims, 34 Drawing Sheets

(56) References Cited

U.S. PATENT DOCUMENTS

| | | | | | |
|---|---|---|---|---|---|
| 3,466,044 | A | | 9/1969 | Somerville | |
| 3,662,508 | A | | 5/1972 | Slayden | |
| 3,696,549 | A | | 10/1972 | Zilius | |
| 3,698,149 | A | | 10/1972 | Baker et al. | |
| 3,752,476 | A | * | 8/1973 | Mahoney | 473/435 |
| 3,782,729 | A | * | 1/1974 | Ernst | 273/138.2 |
| 3,818,628 | A | * | 6/1974 | Ensmann et al. | 446/173 |
| 3,837,648 | A | * | 9/1974 | Breslow | 273/342 |
| 3,946,516 | A | | 3/1976 | Wirth | |
| 3,994,076 | A | | 11/1976 | Bertman et al. | |
| 4,274,221 | A | | 6/1981 | Boutet | |
| 4,378,116 | A | | 3/1983 | Rubik | |
| 4,405,131 | A | | 9/1983 | Horvath | |
| 4,553,749 | A | | 11/1985 | Bender et al. | |
| 4,557,701 | A | | 12/1985 | Giallombardo | |
| 4,602,908 | A | | 7/1986 | Kroeber | |
| 4,650,437 | A | | 3/1987 | Sitkus | |
| D290,026 | S | | 5/1987 | Wichman | |
| D290,028 | S | | 5/1987 | Wichman | |
| D290,143 | S | | 6/1987 | Wichman | |
| 4,713,038 | A | | 12/1987 | Wichman et al. | |
| 4,808,140 | A | | 2/1989 | Clavet | |
| 4,874,342 | A | | 10/1989 | Klitsner | |
| 4,932,917 | A | | 6/1990 | Klitsner | |
| 4,942,700 | A | | 7/1990 | Hoberman | |
| 4,964,833 | A | | 10/1990 | Suzuki | |
| 4,971,246 | A | | 11/1990 | Goudis | |
| 5,024,031 | A | | 6/1991 | Hoberman | |
| 5,039,109 | A | * | 8/1991 | Mahoney et al. | 473/435 |
| 5,044,639 | A | * | 9/1991 | Egging et al. | 273/342 |
| 5,061,218 | A | | 10/1991 | Garage et al. | |
| 5,267,863 | A | | 12/1993 | Simmons, Jr. | |
| 5,273,276 | A | * | 12/1993 | Warren | 473/435 |
| 5,292,126 | A | | 3/1994 | Hanley | |
| 5,312,285 | A | | 5/1994 | Rieber et al. | |
| 5,314,367 | A | * | 5/1994 | Schaefer | 446/168 |
| 5,332,216 | A | | 7/1994 | Whipple | |
| D350,784 | S | | 9/1994 | Nielsen et al. | |
| 5,344,143 | A | | 9/1994 | Yule | |
| 5,386,994 | A | | 2/1995 | Baranowski | |
| 5,451,177 | A | | 9/1995 | Gilman | |
| 5,494,292 | A | | 2/1996 | Mileti | |
| 5,525,089 | A | | 6/1996 | Heinz | |
| 5,709,581 | A | * | 1/1998 | Rothbarth et al. | 446/171 |
| 5,826,394 | A | | 10/1998 | Barton et al. | |
| D403,028 | S | | 12/1998 | Barton, Jr. et al. | |
| 5,924,907 | A | | 7/1999 | Tobin | |
| 5,928,052 | A | | 7/1999 | Buscher | |
| 5,944,575 | A | | 8/1999 | Tolnay | |
| 5,947,870 | A | | 9/1999 | Hall et al. | |
| 6,056,620 | A | * | 5/2000 | Tobin | 446/168 |
| D428,912 | S | | 8/2000 | Bolle | |
| D430,231 | S | | 8/2000 | Sorensen et al. | |
| 6,248,026 | B1 | | 6/2001 | Wanchena | |
| 6,250,634 | B1 | * | 6/2001 | Strain et al. | 273/395 |
| 6,273,778 | B1 | | 8/2001 | Kyster | |
| 6,293,800 | B1 | | 9/2001 | Robertson | |
| 6,340,323 | B1 | | 1/2002 | Glynn | |
| D456,463 | S | | 4/2002 | Sorensen | |
| 6,427,926 | B1 | | 8/2002 | Lai | |
| D465,247 | S | | 11/2002 | Sorensen | |
| 6,536,763 | B1 | | 3/2003 | Braun | |
| 6,568,679 | B1 | | 5/2003 | Sommer | |
| 6,588,168 | B2 | | 7/2003 | Walters | |
| 6,616,499 | B1 | | 9/2003 | Sorensen | |
| 6,645,033 | B1 | | 11/2003 | Thomsen | |
| 6,733,403 | B2 | * | 5/2004 | Courtright | 473/433 |
| D492,736 | S | | 7/2004 | Kato | |
| 7,524,246 | B2 | * | 4/2009 | Briggs et al. | 472/128 |
| 2011/0070803 | A1 | * | 3/2011 | Hoffman et al. | 446/168 |

FOREIGN PATENT DOCUMENTS

| | | | | |
|---|---|---|---|---|
| FR | 2646096 | | 10/1990 | |
| FR | 2763514 | * | 11/1998 | A63B 69/00 |
| GB | 867244 | | 5/1961 | |
| JP | 59500549 | | 4/1984 | |
| JP | 61103199 | | 7/1986 | |
| JP | 62061279 | | 4/1987 | |
| JP | 3053277 | | 5/1991 | |
| JP | 1094681 | | 4/1998 | |
| JP | 4619930 | | 1/2011 | |
| WO | 9426372 | | 11/1994 | |
| WO | 9835880 | | 8/1998 | |

OTHER PUBLICATIONS http://www.nikitiki.co.jp/toymakers/16/menu/html, Sep. 14, 2006, 1 pg.

http://www.taurustoy.com/ The Block and Marble Maze Construction System, Block-N-Roll™, Sep. 14, 2006, 2 pgs.

http://www.sommercube.com/index.html, Symmetry Under Transformation, Sommer Cube®, Mar. 9, 2006, 4 pgs.

http://www.klimba.ch/d/produkte/maxi.php, Klimba-die klingende Kugelbahn, Mar. 20, 2006, 4 pgs.

http://www.klimba.ch/klimba2005/suissetoy05/pages/127-2729.html, Klimba-die klingende Kugelbahn, Sep. 14, 2006, 2 pgs.

http://www.quercetti.com/construction.htm, Quercetti Intelligent Toys—Marble Run, Mar. 11, 2005, 2 pgs.

http://www.quercetti.com/new-2001/marblespiral.htm, Quercetti Intelligent Toys—Marble Run #6558, Mar. 11, 2005, 1 pg.

http://www.quercetti.com/new-2001/marblevortex.htm, Quercetti Intelligent Toys—Marble Run #6538, Mar. 11, 2005, 1 pg.

http://www.quercetti.com/new-2001/supermarble.htm, Quercetti Intelligent Toys—Marble Run #6588, Mar. 11, 2005, 1 pg.

http://www.quercetti.com/new-2001/marbletransparent.htm, Quercetti Intelligent Toys—Marble Run #6546, Mar. 11, 2005, 1 pg.

http://www.quercetti.com/marbles/supermarble.htm, Quercetti Intelligent Toys—Marble Run, Mar. 11, 2005, 2 pgs.

http://www.quercetti.com/new-2001/sky6440.htm, Quercetti Intelligent Toys—Skyrail™ #6440, Mar. 11, 2005, 1 pg.

http://www.quercetti.com/new-2001/skysuspension.htm, Quercetti Intelligent Toys—Suspension #6450, Mar. 11, 2005, 2 pgs.

http://www.quercetti.com/new-2001/skybase.htm, Quercetti Intelligent Toys—Roller Coaster #6430, Mar. 11, 2005, 2 pgs.

http://www.quercetti.com/new-2001/skyroller.htm, Quercetti Intelligent Toys—Roller Coaster #6435, Mar. 11, 2005, 2 pgs.

http://www.quercetti.com/new-2001/crazyrun.htm, Quercetti Intelligent Toys—Crazyrun Magnetic #6410, Mar. 11, 2005, 1 pg.

http://www.galttoys.com/ind_products.php?id=A0555K, GALT Marble Run, Mar. 11, 2005, 1 pg.

http://www.galttoys.com/ind_products.php?id=A0560E, GALT Super Marble Run, Mar. 11, 2005, 1 pg.

http://www.galttoys.com/ind_products.php?id=A0512, GALT Marble Racer-120, Mar. 11, 2005, 1 pg.

http://www.frigits.com, Frigits, Mar. 11, 2005, 2 pgs.

http://wvvw.educationaltoys.co.uk/acatalog/ET_Online_Catalogue_Marble_Runs_18html Mar. 11, 2006, 4 pgs.

http://www.scalino.de/site-eur/produkte/mk-gt-d.htm, Glockenturn, Art, Nr. 641, Mar. 11, 2005, 1 pg.

http://www.scalino.de/site-eur/produkte/gk-st0-d.htm, Stufe 0, Art. Nr. 600, Mar. 11, 2005, 1 pg.

http://www.scalino.de/site-eur/produkte/gk-st1-d.htm, Stufe 1, Art. Nr. 601, Mar. 11, 2005, 1 pg.

http://www.scalino.de/site-eur/produkte/gk-st2-d.htm, Stufe 2, Art. Nr. 602, Mar. 11, 2005, 1 pg.

http://www.scalino.de/site-eur/produkte/gk-st3-d.htm, Stufe 3, Art. Nr. 603, Mar. 11, 2005, 1 pg.

http://www.haba.de/Kugelbahn.kba.0html?&tx_habaproducts_pi1[showUid]=601&tx_hab . . . , Haba: Erfinder fur Kinder, Mar. 11, 2005, 2 pgs.

(56) References Cited

OTHER PUBLICATIONS http://www.haba.de/Kugelbahn.kba.0html?&tx_habaproducts_pi1[showUid]=588&tx_hab . . . , Haba: Erfinder fur Kinder, Mar. 11, 2005, 2 pgs.
http://www.elc.co.uk/sku-107346/pl-Puzzles/p2-30/Product.do, Marble Madness, Mar. 11, 2005, 1 pg.
http://www.mastermindtoys.com/stor/product.asp?produce%5Fcode=47711&cat=0&brand . . . , Block-N-Roll Deluxe Set, Mar. 11, 2005, 2 pgs.
http://cuburo.ch, Cuboro, The marble track for a lifetime, Swiss made, mod. dep., 1986-2005, 10 pgs.
International Search Report and Written Opinion for related PCT Application PCT/US2013/050151, mailed Oct. 9, 2013, 10 pgs.

* cited by examiner

ACCESSORIES TO A MODULAR PATHWAY APPARATUS

CROSS-REFERENCE TO RELATED APPLICATIONS

The present application claims priority to U.S. Provisional Application No. 61/670,370 filed on Jul. 11, 2012 entitled Accessories to Modular Pathway Apparatus and U.S. Provisional Application No. 61/794,220 filed on Mar. 15, 2013 entitled Accessories to Modular Pathway Apparatus, the content of each of which are hereby incorporated by reference herein in their entireties.

FIELD OF THE INVENTION

The present disclosure relates generally to an accessory or accessories that may be used with a modular pathway apparatus. More particularly, the accessory or accessories may be attached, secured, anchored, or otherwise fastened to or arranged in and/or around a modular pathway apparatus and adapted for interaction with objects, fluids, or other moveable matter passing through, across, under, or around the apparatus or otherwise interacting with the apparatus. Still more particularly, the accessory or accessories may include a device such as a trampoline, spring, cushion, or otherwise resilient device for receiving and rebounding an object moving through, across, under, over, or around the apparatus.

BACKGROUND

Trampolines for use with marble runs have been provided. However, the methods and devices for securing and positioning the trampoline relative to the marble run are cumbersome and difficult to use and are also imprecise, difficult to adjust and/or do not provide a consistent response with respect to an incoming and a rebounding object.

SUMMARY

In some embodiments, an accessory to a modular pathway apparatus may include a base and a rebounding portion configured to rebound an impacting object. The accessory may also include an adjustment portion coupled to the base and the rebounding portion. The adjustment portion may support the rebounding portion relative to the base and may be configured for one, two, or three degrees of rotational freedom relative to the base.

In another embodiment, a trampoline may include a base and a rebounding portion configured to rebound an impacting object. The trampoline may also include a means for supporting the rebounding portion relative to the base and providing for three degrees of rotational freedom of the rebounding portion relative to the base.

While multiple embodiments are disclosed, still other embodiments of the present invention will become apparent to those skilled in the art from the following detailed description. As will be apparent, the invention is capable of modifications in various obvious aspects, all without departing from the spirit and scope of the present invention. Accordingly, the detailed description is to be regarded as illustrative in nature and not restrictive.

BRIEF DESCRIPTION

Figure 4:
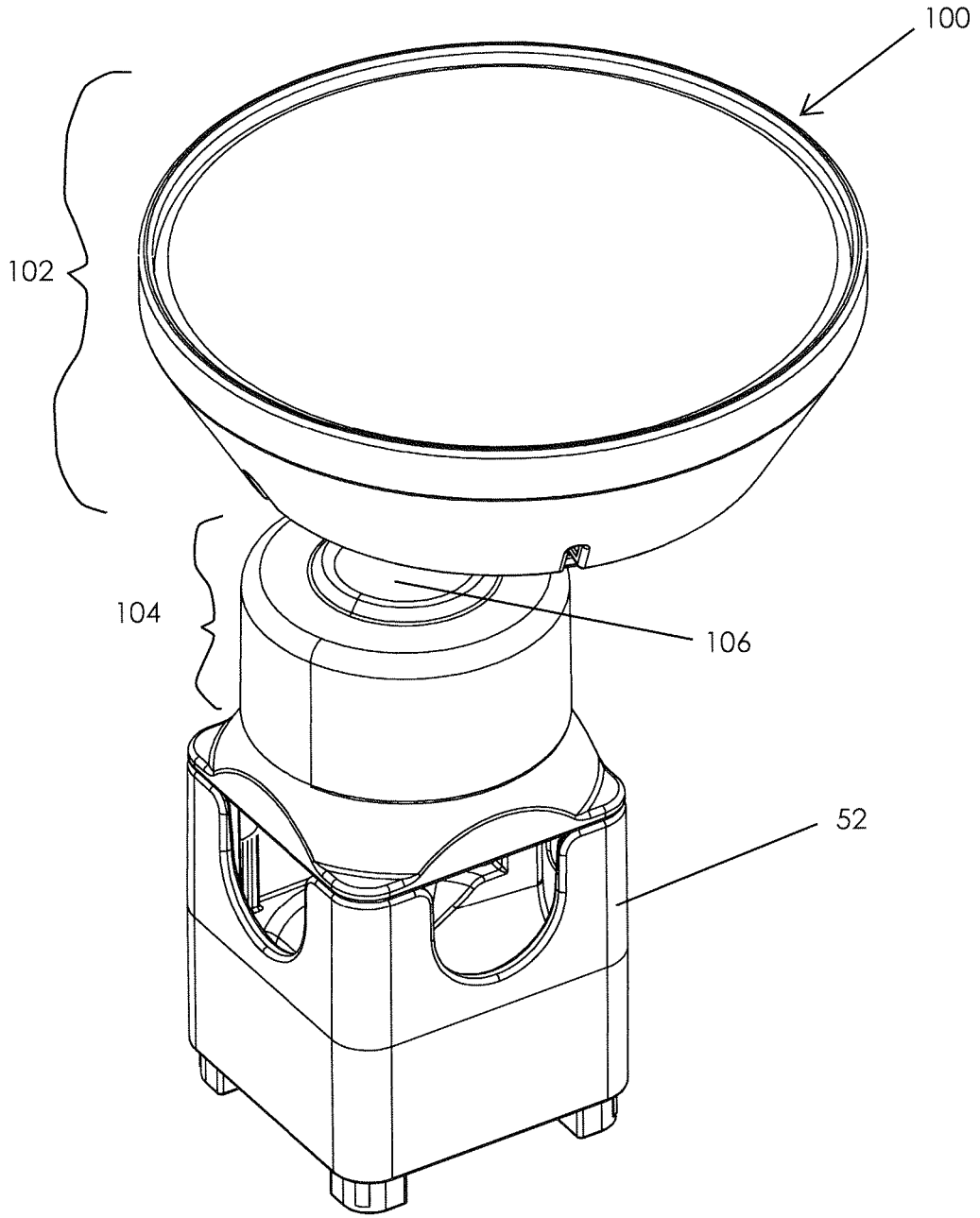
FIG. 4 is a perspective view of an accessory to a modular pathway apparatus in position on a modular member of the apparatus.

FIGS. 6A, 6B, 6C, 6D, and 6E are top, perspective top, perspective front, perspective bottom, and cross-sectional views, respectively, of a support or frame portion of the accessory of FIG. 4.

FIGS. 6F, 6G, 6H, 6I, 6J, and 6K are top, perspective front, side, perspective top, close-up, and perspective bottom views of a resilient member for positioning on the frame of FIGS. 6A-6E.

FIGS. 7A, 7B, 7C, 7D, and 7E are top, perspective top, perspective front, perspective bottom, and cross-sectional views, respectively, of a cover portion of the accessory of FIG. 4.

FIGS. 8A, 8B, 8C, 8D, and 8E are top, perspective top, perspective front, perspective bottom, and cross-sectional views, respectively of an adjustment portion of the accessory of FIG. 4.

FIGS. 8F, 8G, 8H, 8I, and 8J are top, perspective front, perspective top, perspective bottom, and cross-sectional views, respectively of an adjustment portion of an accessory, according to some embodiments.

FIGS. 9A, 9B, 9C, 9D, and 9E are top, perspective top, perspective front, perspective bottom, and cross-sectional views, respectively of a top cap portion of a base of the accessory of FIG. 4.

FIGS. 10A, 10B, 10C, 10D, and 10E are top, perspective top, perspective front, perspective bottom, and cross-sectional views, respectively of a securing portion of a base of the accessory of FIG. 4.

FIGS. 11A, 11B, 11C, 11D, and 11E are top, perspective top, perspective front, perspective bottom, and cross-sectional views, respectively of a connector portion of the accessory of FIG. 4.

Figure 1A:
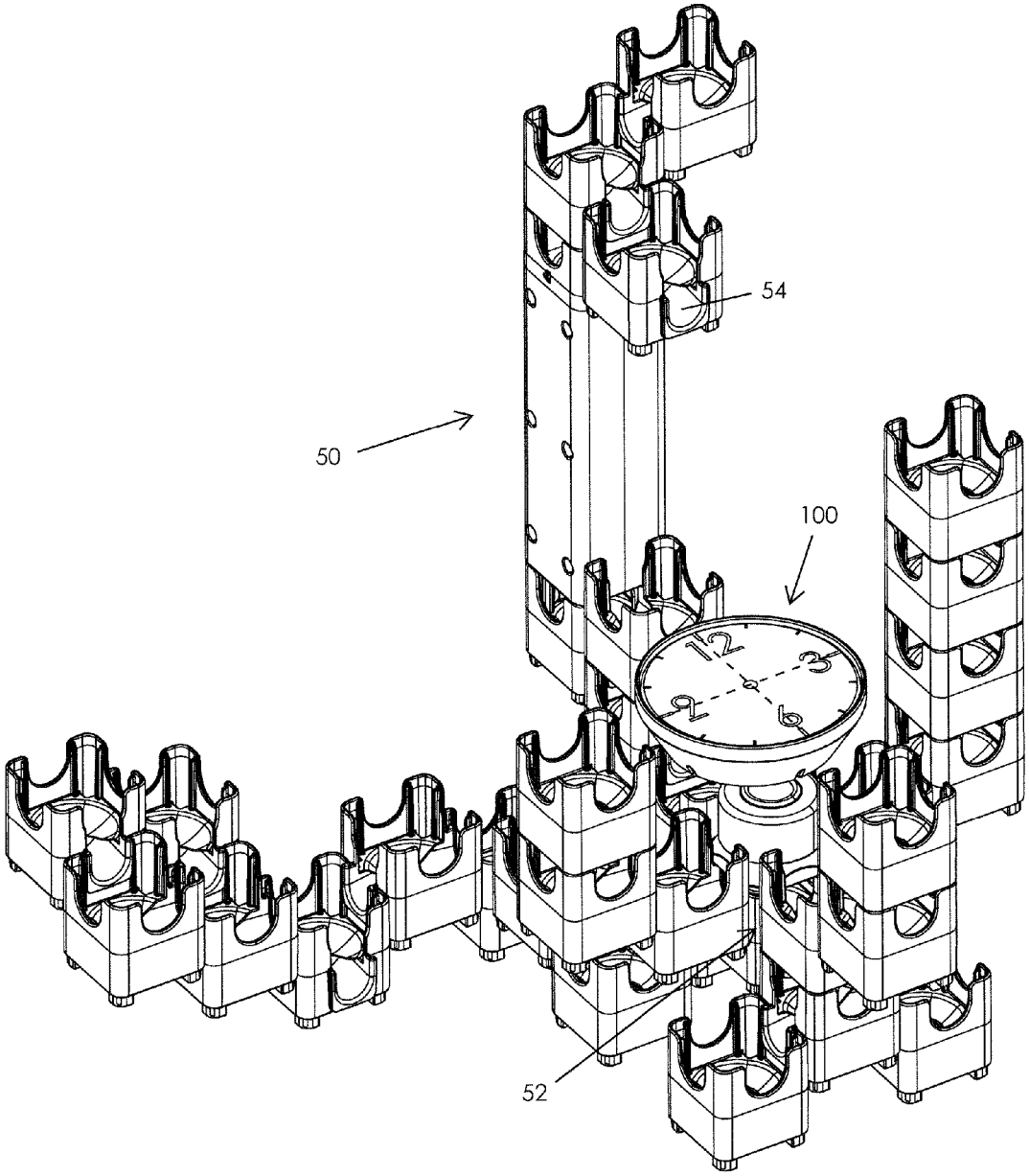
FIG. 1A is a perspective view of an accessory arranged with a modular pathway apparatus, according to some embodiments.

FIGS. 12A, 12B, 12C, 12D, and 12E are top, perspective top, perspective front, perspective bottom, and cross-sectional views, respectively of a modular member of the apparatus of FIG. 1A, according to some embodiments.

Figure 13A:
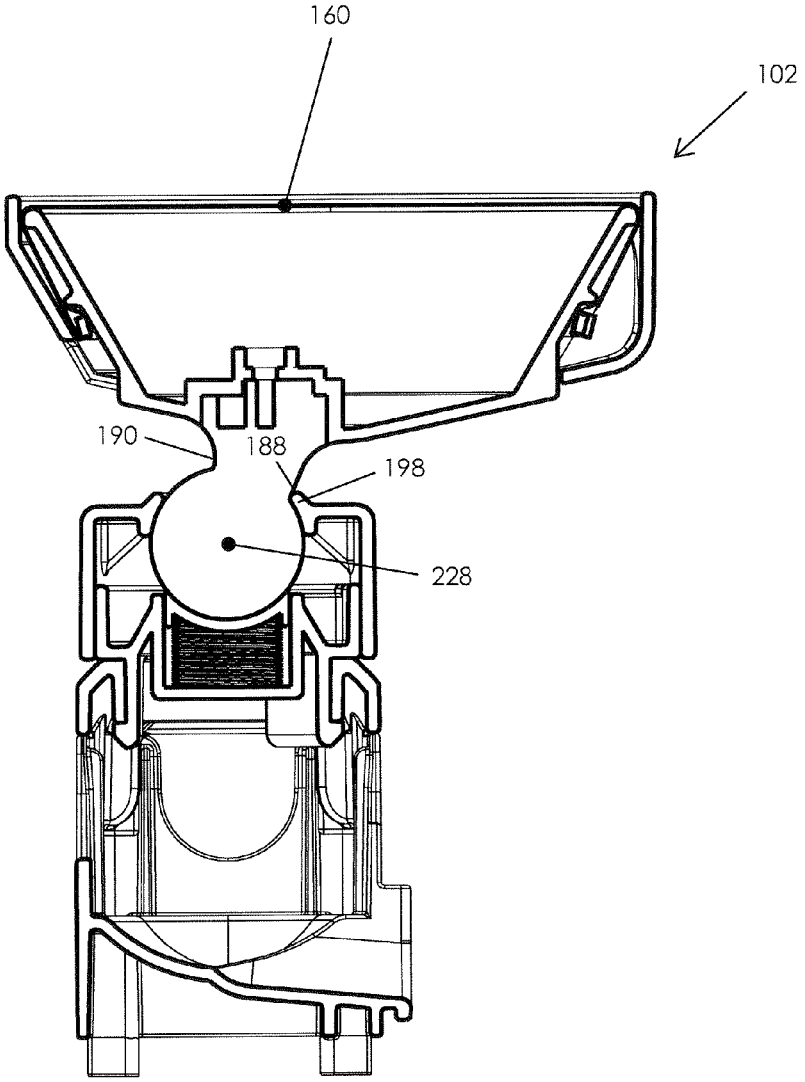

FIG. 13A is a cross-sectional view of the accessory of FIG. 4 with an adjustable portion in a substantially horizontal position.

Figure 13B:
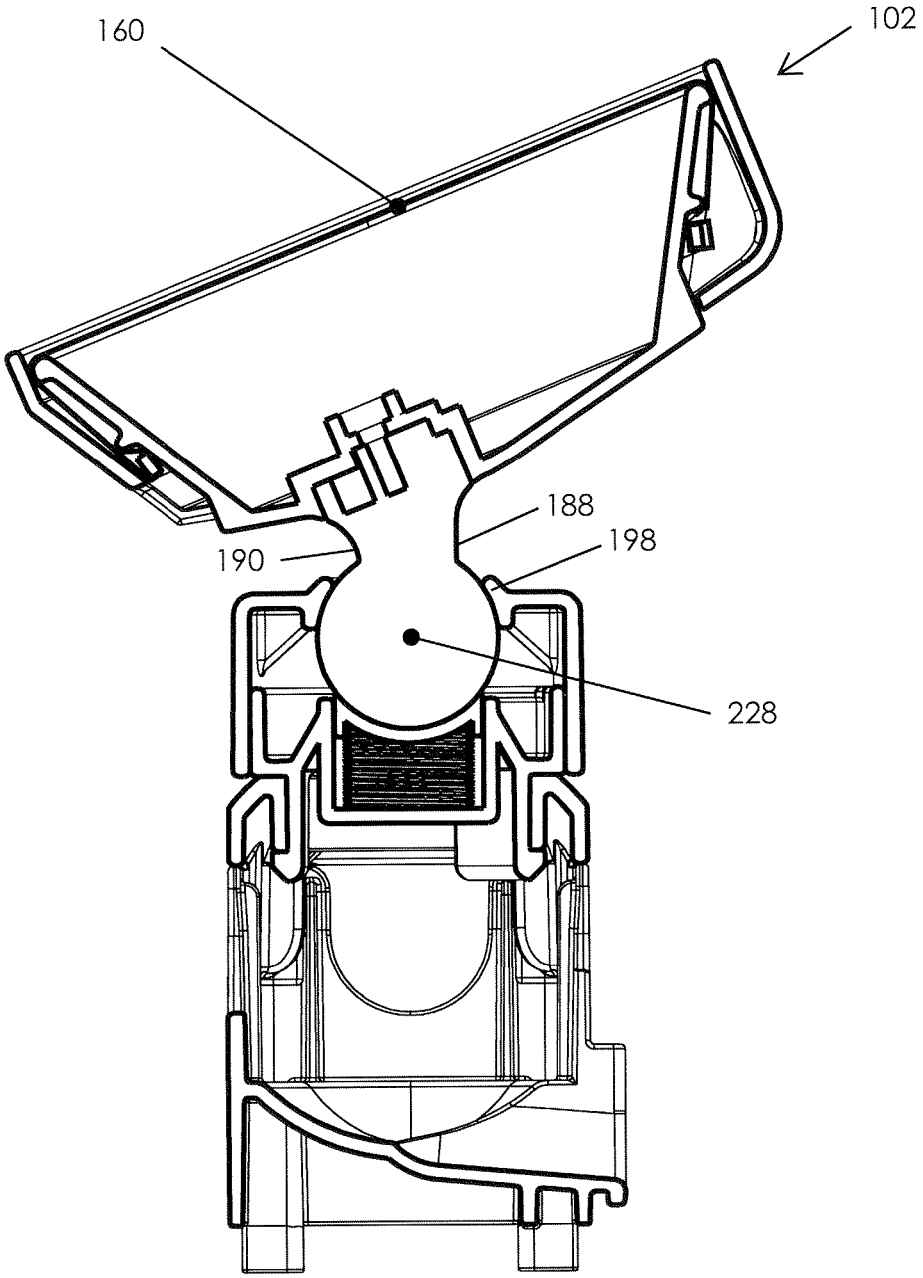

FIG. 13B is a cross-sectional view of the accessory of FIG. 4 with the adjustable portion in a slightly canted position.

Figure 13C:
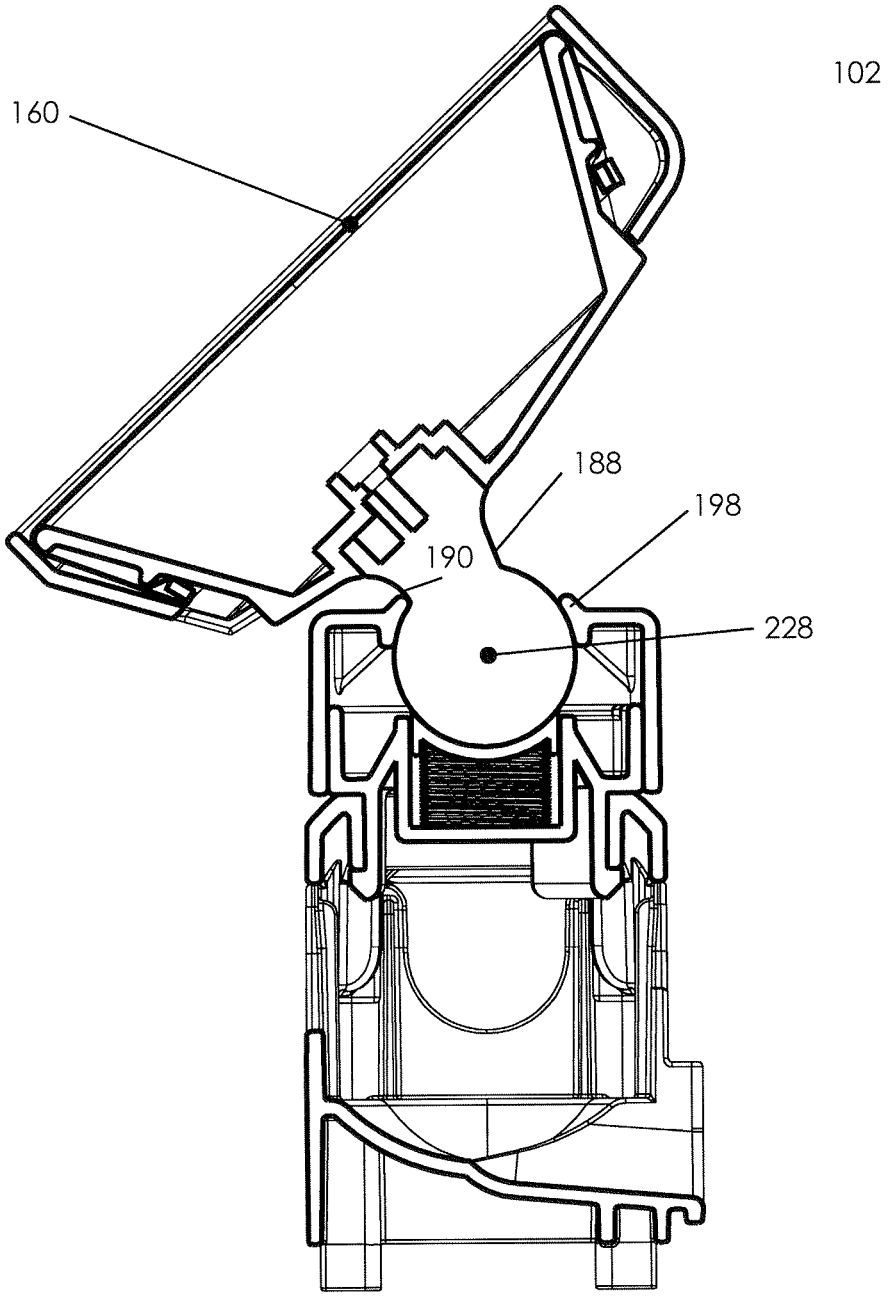

FIG. 13C is a cross-sectional view of the accessory of FIG. 4 with the adjustable portion in an additionally canted position relative to the position in FIG. 13B.

Figure 13D:
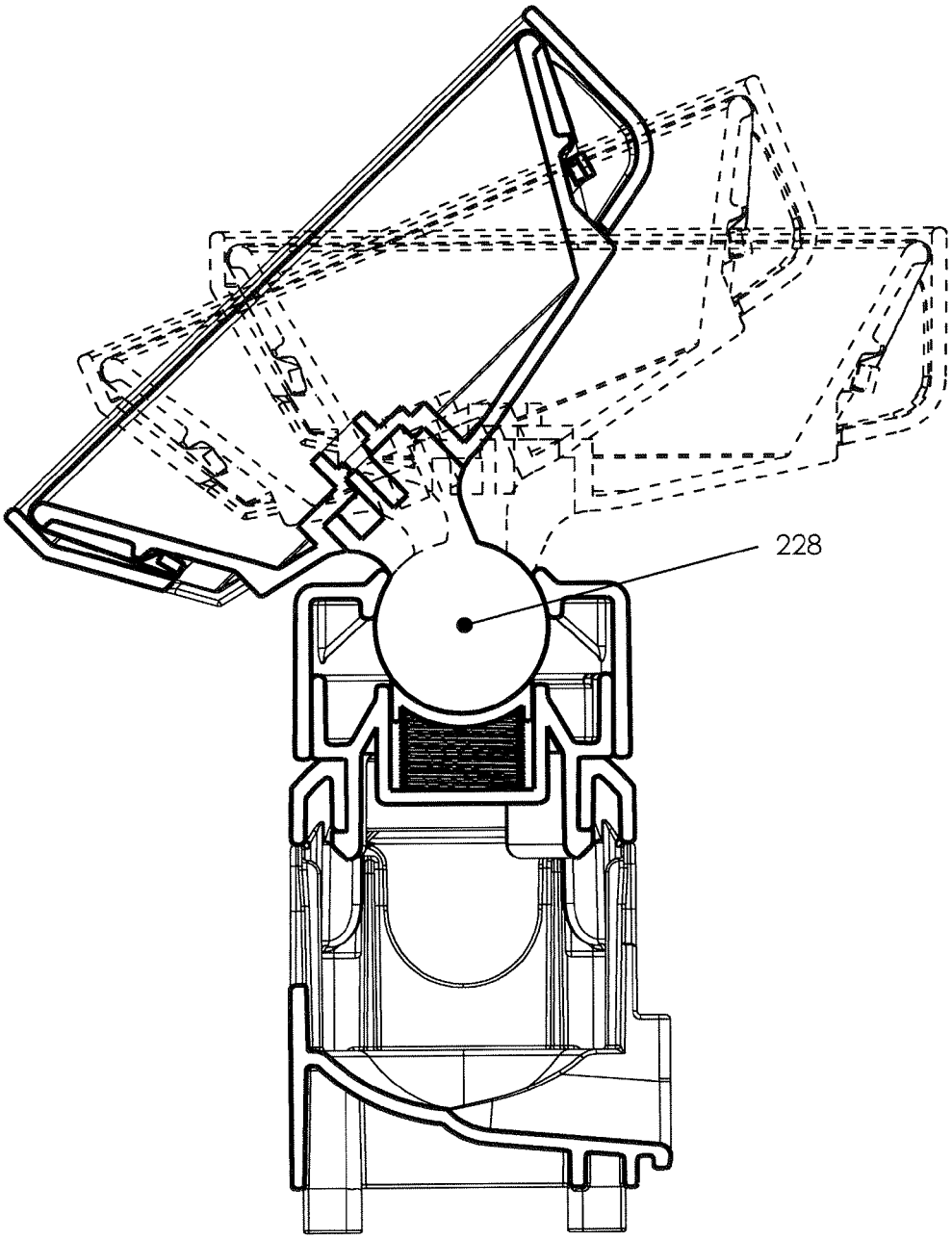

FIG. 13D is a cross-sectional view of the accessory of FIG. 4 showing the adjustable portion is a series of positions.

Figure 13E:
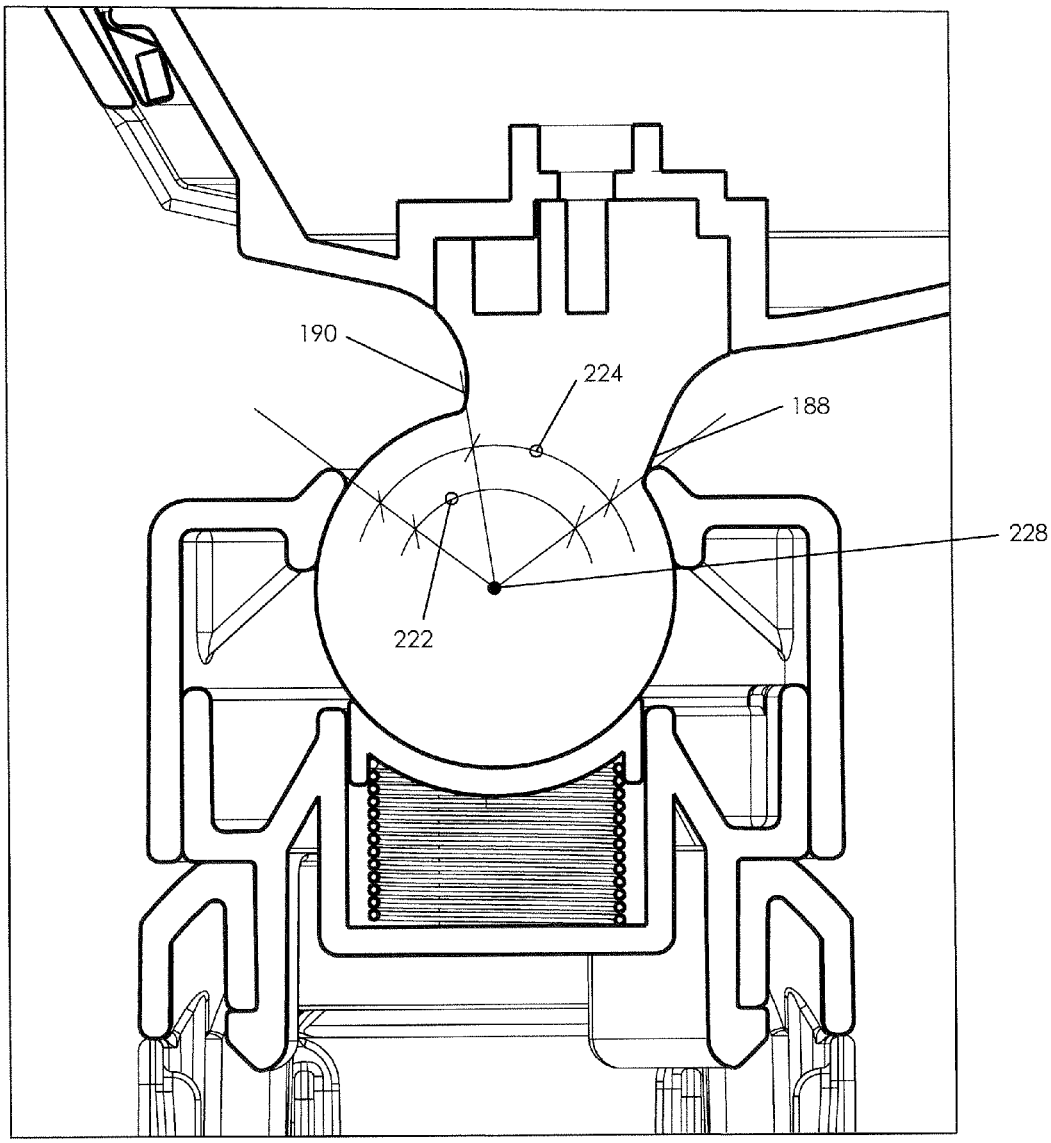

FIG. 13E is a close-up view of a plug and socket portion of the cross-section of FIG. 13A.

Figure 14:
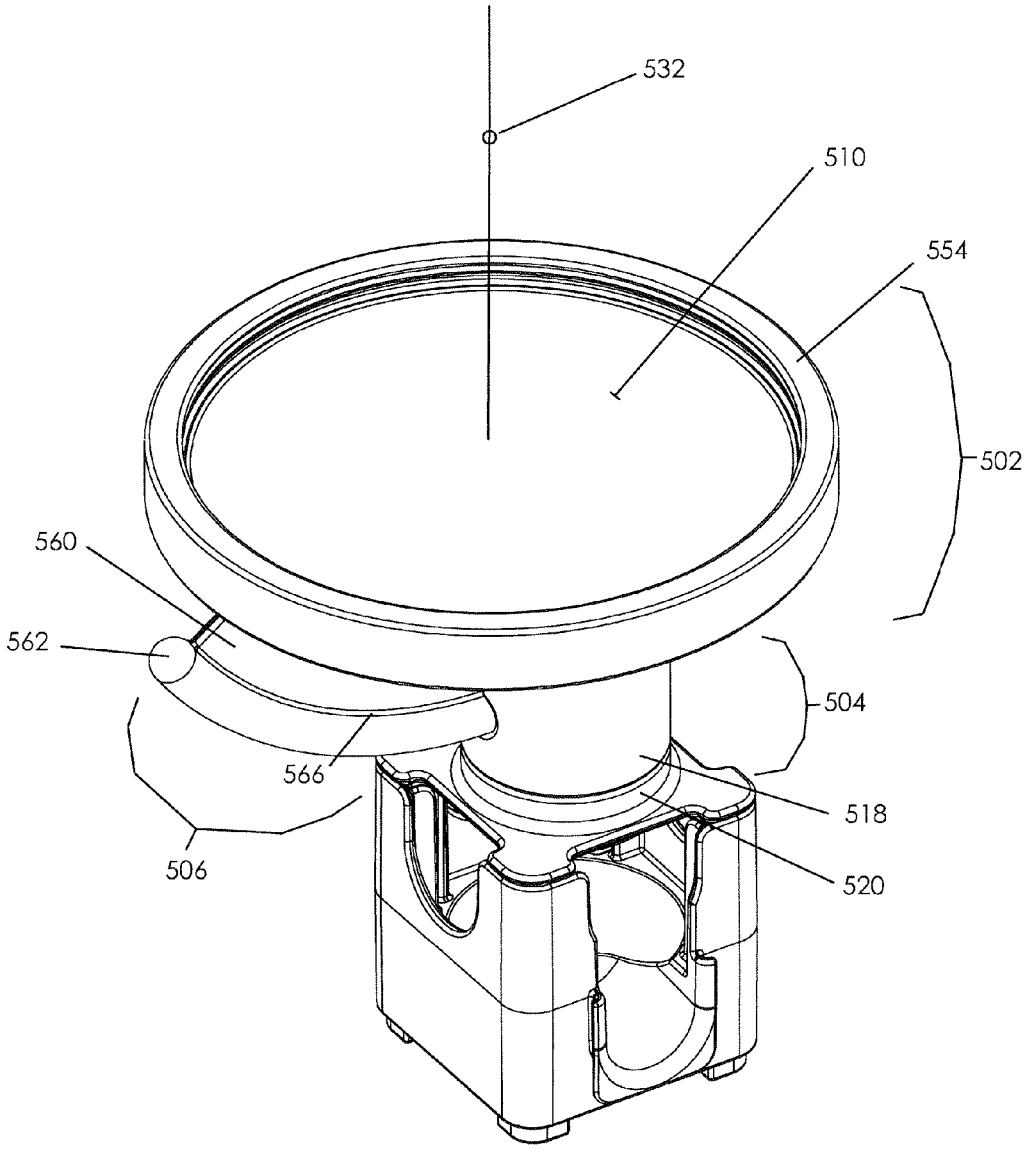

FIG. 14 is a perspective view of an accessory for a modular pathway apparatus, according to some embodiments.

Figure 15:
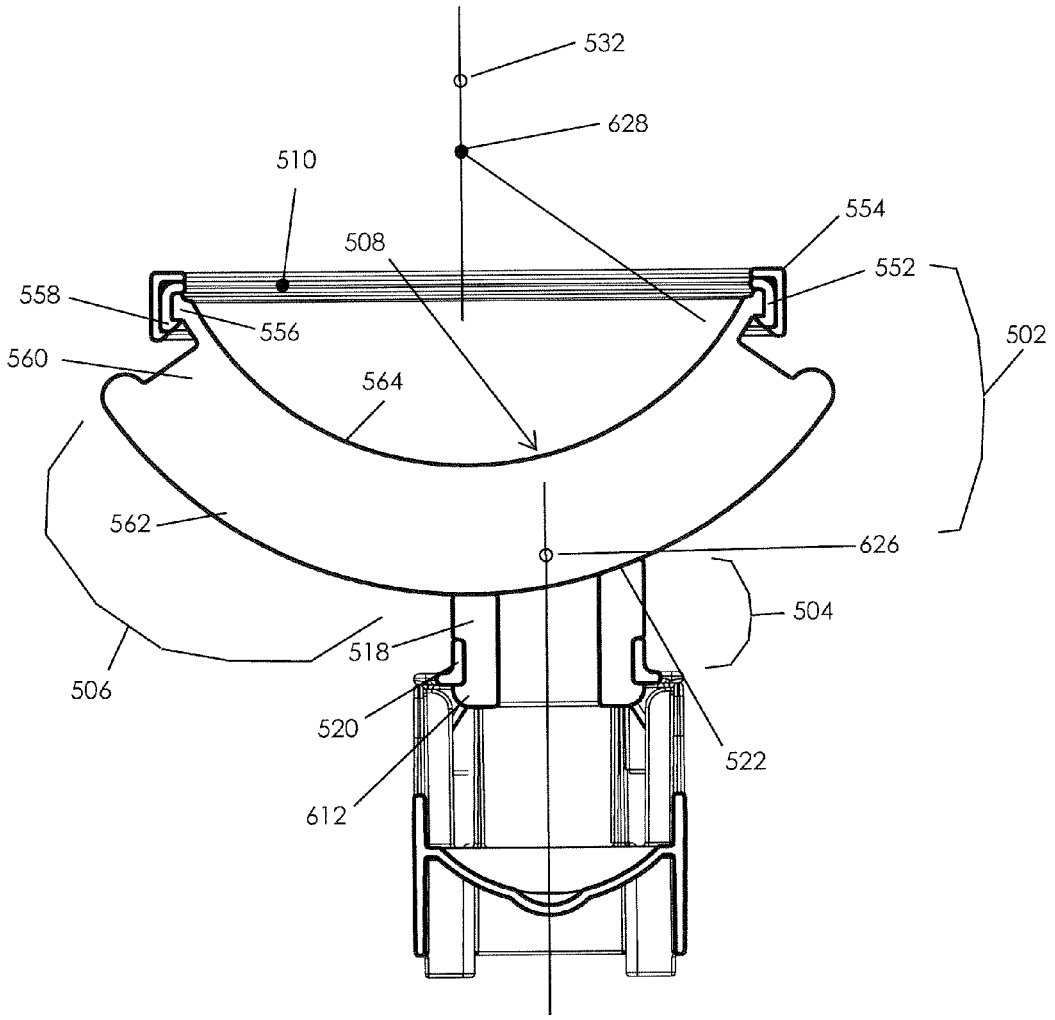

FIG. 15 is a cross-sectional view of the accessory of FIG. 14.

Figure 16:
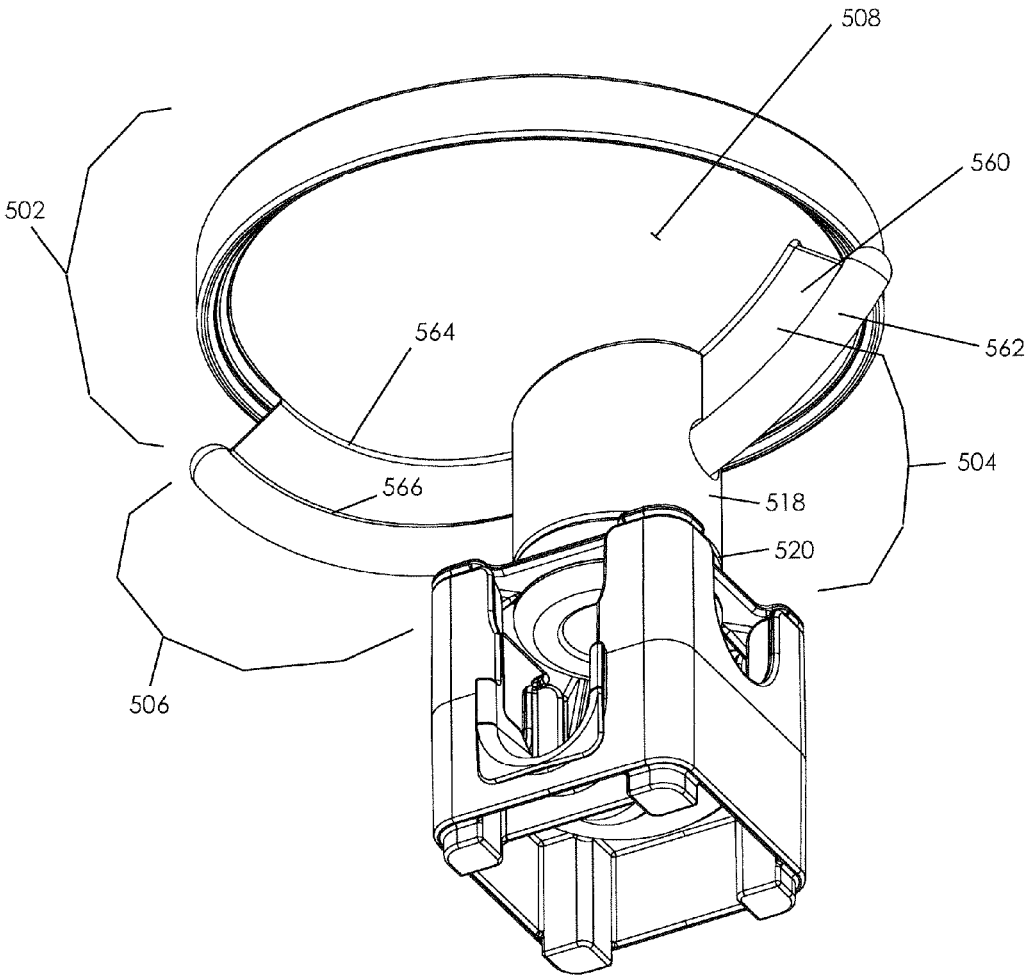

FIG. 16 is a bottom perspective view of the accessory of FIG. 14.

Figure 17:
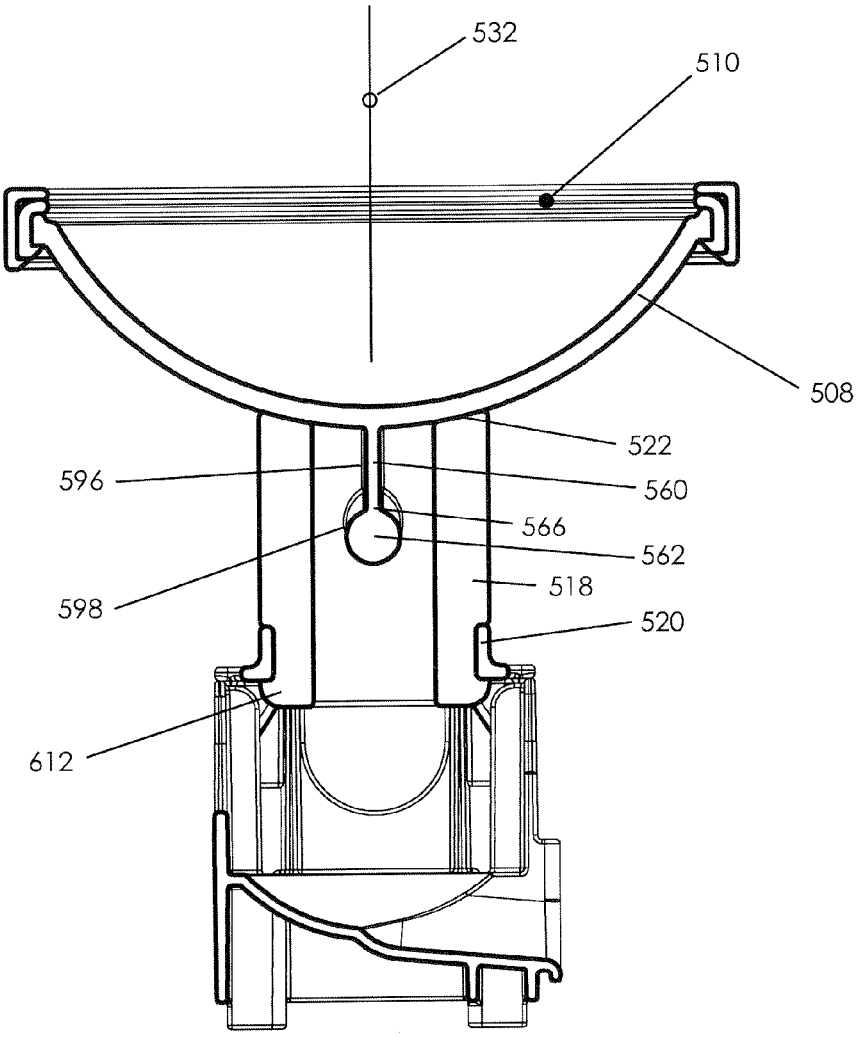

FIG. 17 is a cross-sectional view of the accessory of FIG. 14.

Figure 18:
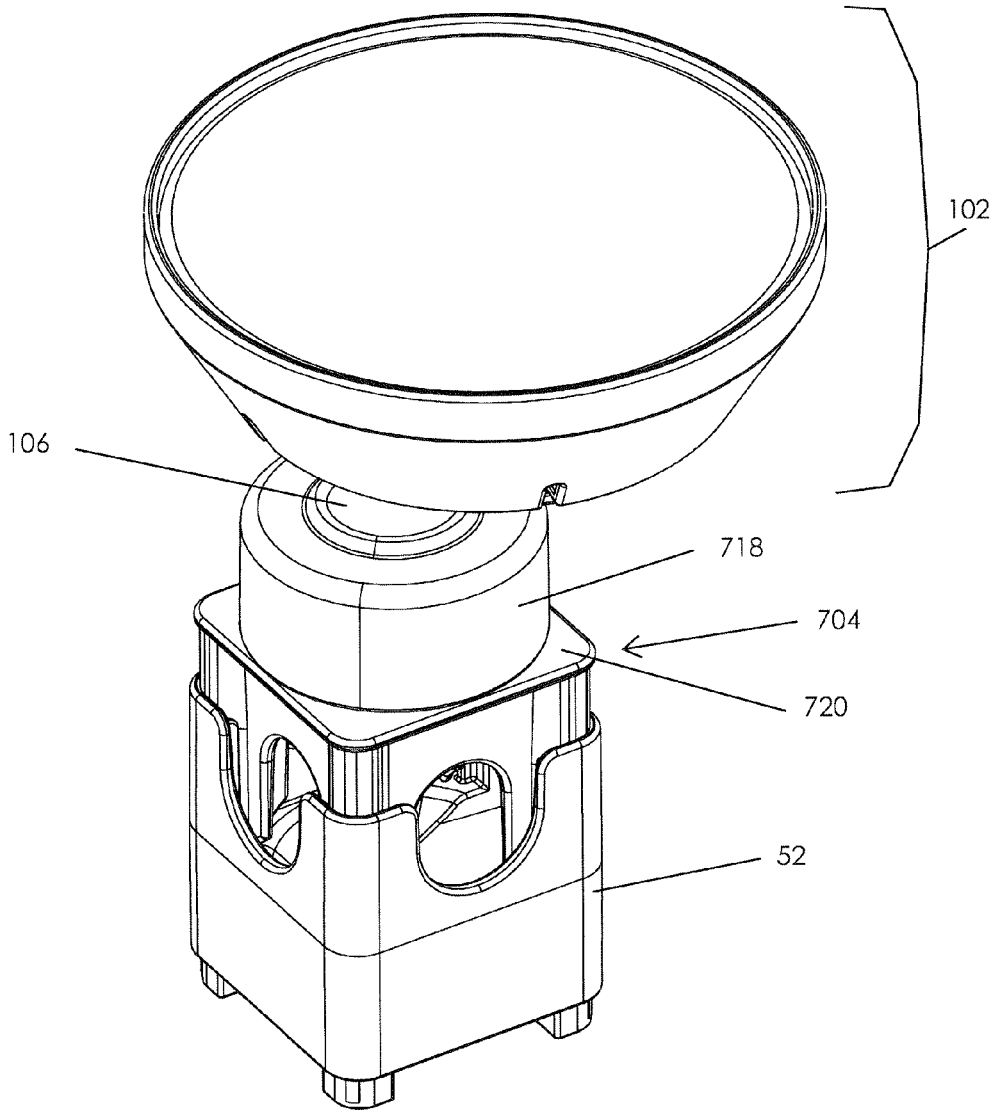

FIG. 18 is perspective view of an accessory secured to a modular member, according to some embodiments.

Figure 19:
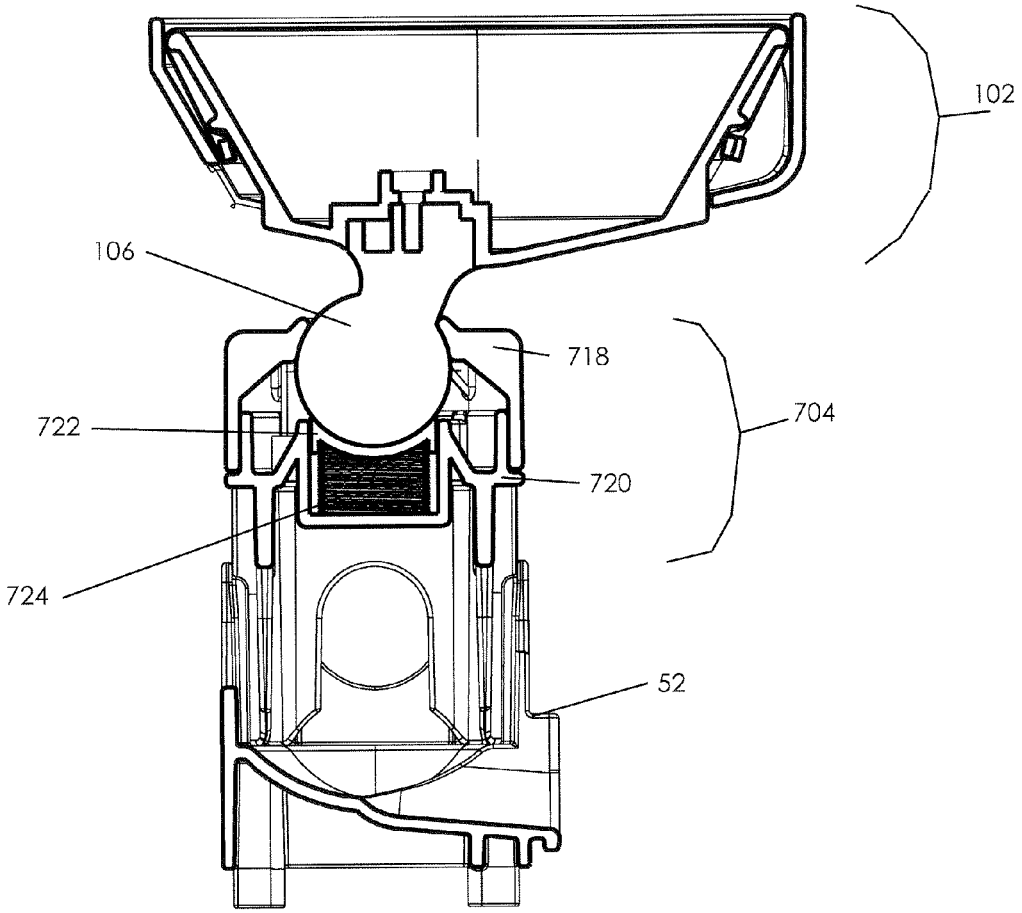
Figure 20A:
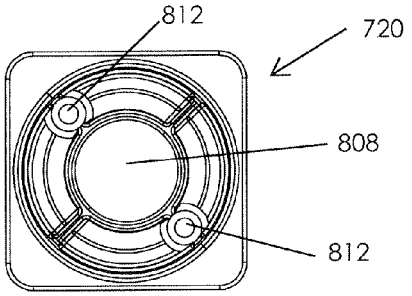
Figure 20B:
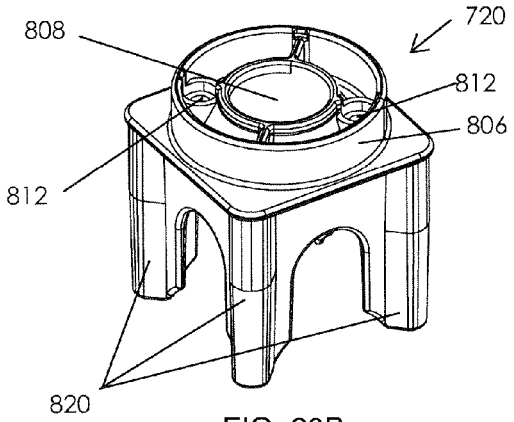
Figure 20C:
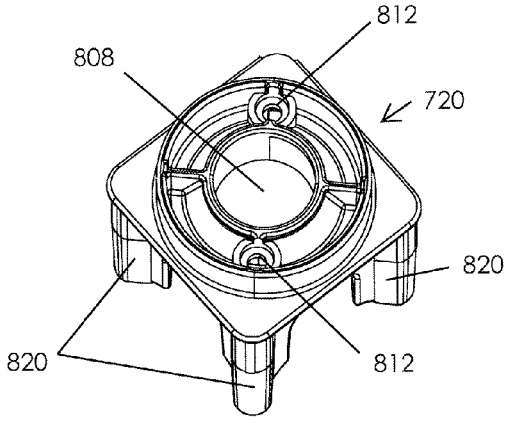
Figure 20E:
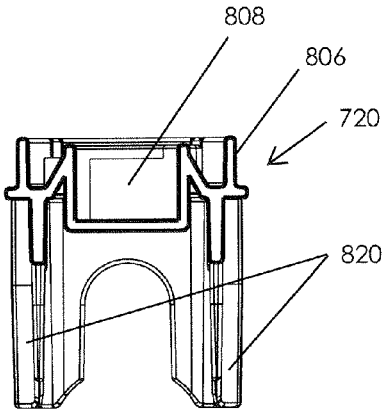
Figure 20D:
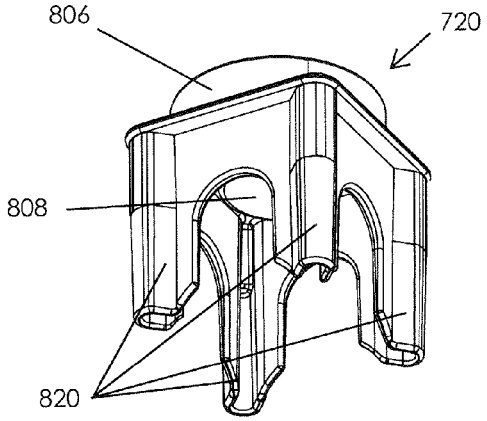

FIG. 19 is a cross-sectional view of the accessory and modular member of FIG. 18.

FIGS. 20A, 20B, 20C, 20D, and 20E are top, perspective top, perspective front, perspective bottom, and cross-sectional views, respectively, of a connector of the accessory of FIG. 18.

Figure 21:
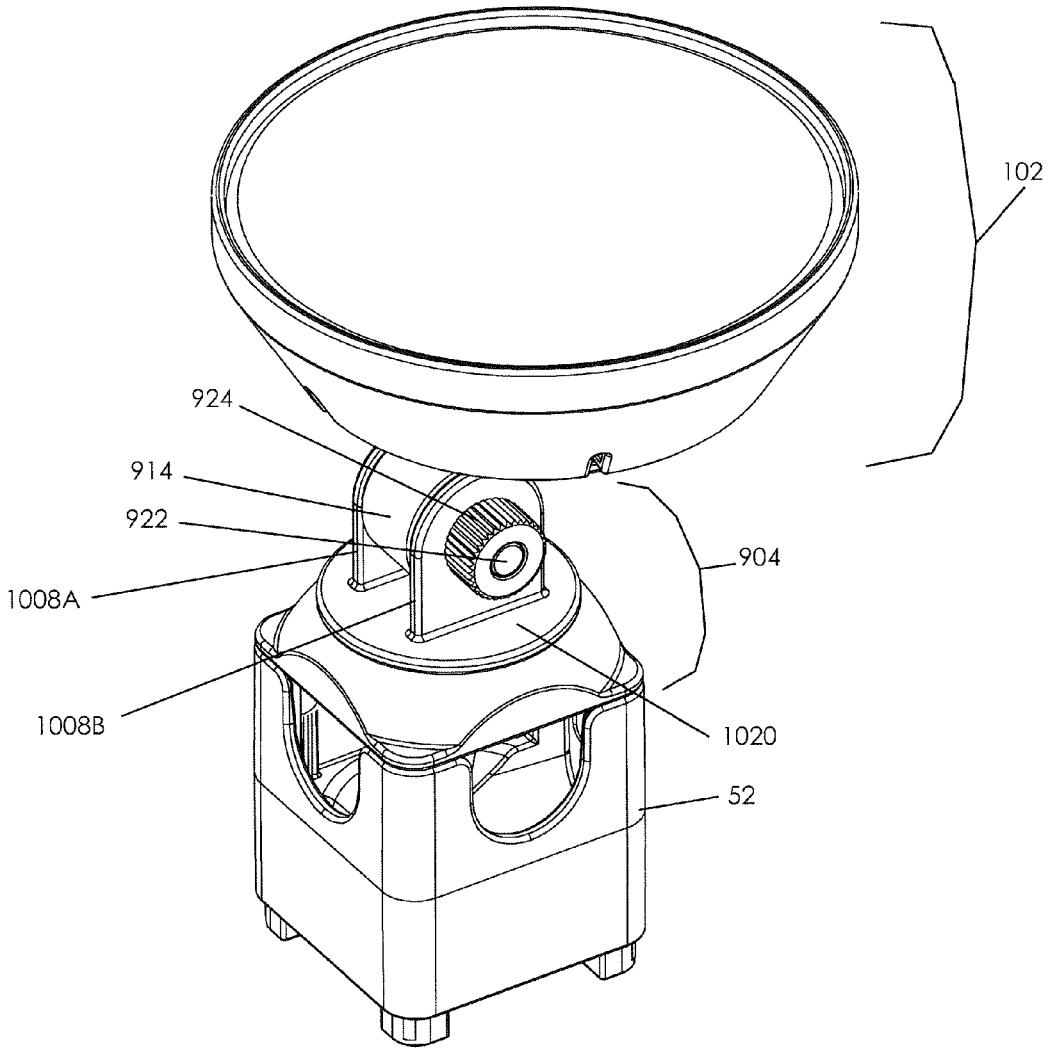

FIG. 21 is perspective view of an accessory secured to a modular member, according to some embodiments.

Figure 22:
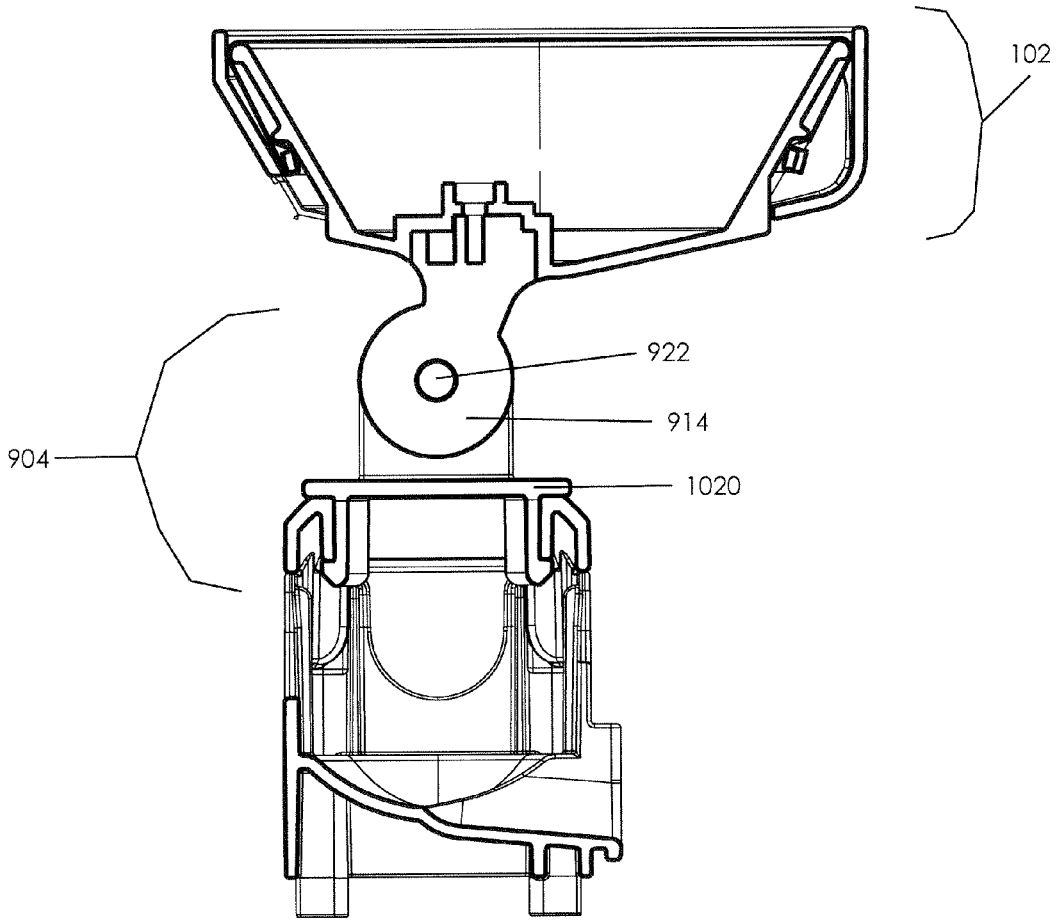
Figure 23A:
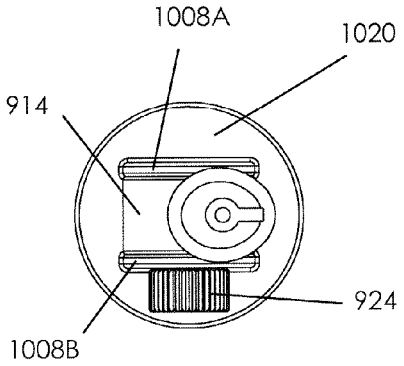
Figure 23B:
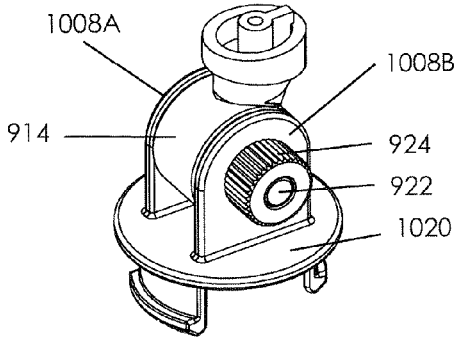
Figure 23C:
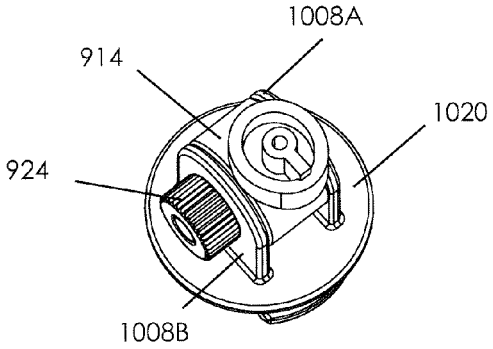
Figure 23E:
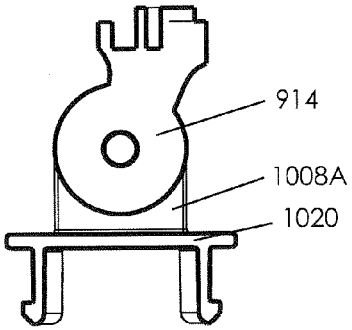
Figure 23D:
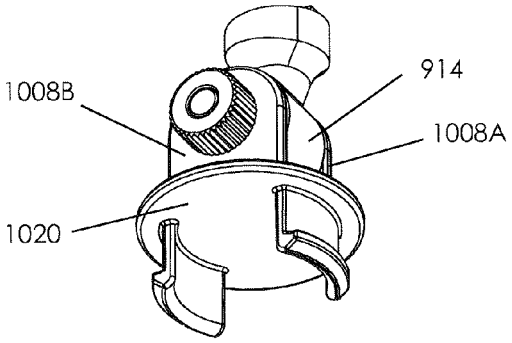

FIG. 22 is a cross-sectional view of the accessory and modular member of FIG. 21.

FIGS. 23A, 23B, 23C, 23D, and 23E are top, perspective top, perspective front, perspective bottom, and cross-sectional views, respectively, of a base and adjustment portion of the accessory of FIG. 21.

DETAILED DESCRIPTION

The present disclosure, in some embodiments, relates to an accessory such as a trampoline device having a resilient area for receiving and rebounding an object or marble, for example. The trampoline may be arranged on or around a modular pathway apparatus such as a marble run and may be configured to have marbles or other objects impact its surface and be rebounded off of the surface and to or toward other portions of the apparatus. The trampoline may be easily adjustable in one or more directions and/or orientations such that the resilient area may be positioned and oriented in one of a multitude of positions relative to the pathway apparatus without detaching and reattaching the trampoline to the apparatus, for example. While adjustable, the trampoline may also remain substantially stationary in the adjusted position to provide for consistency in the relative trajectory between incoming and outgoing objects or marbles. As such, the trampoline may provide for an exciting accessory to a modular pathway apparatus and may be easy to use, easily adjustable, and may provide for a consistent rebound of incoming objects or marbles. It is to be appreciated that while the accessory is described herein as being suitable for use with a modular pathway apparatus, it may also be used with other types of marble runs, games, or systems and is not limited to use with a modular pathway apparatus.

Figure 1B:
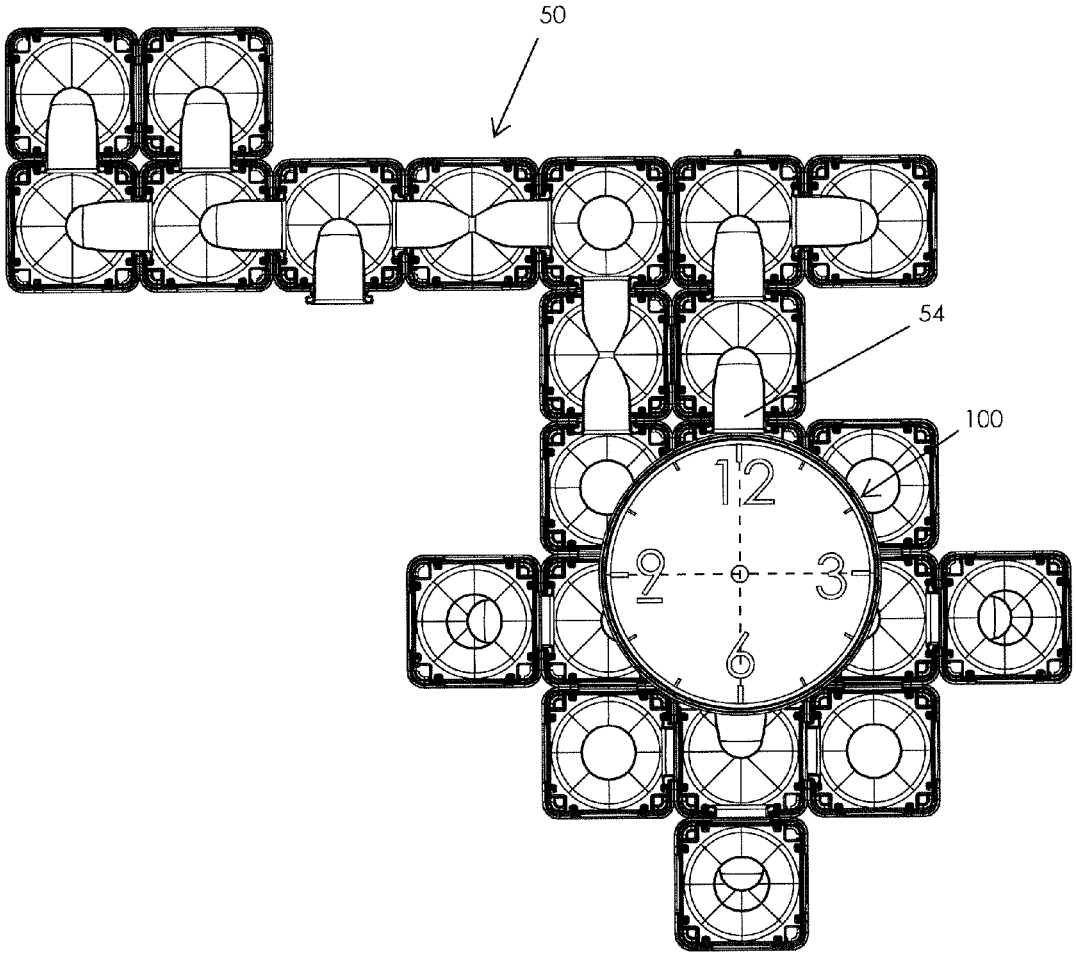
FIG. 1B is top view of the accessory and apparatus of FIG. 1A.
Figure 2A:
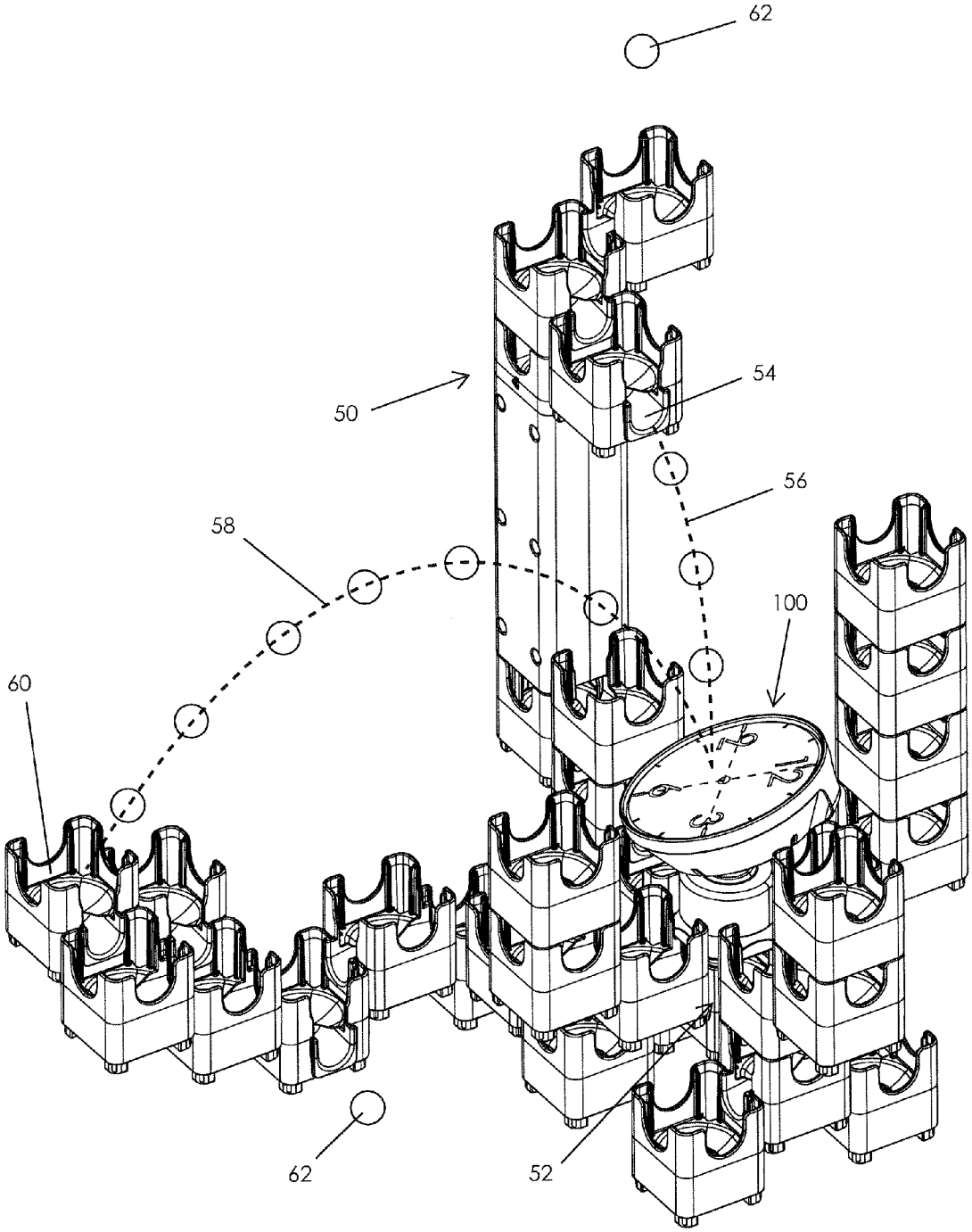
FIG. 2A is a perspective view of the accessory and a partially modified configuration of the apparatus of FIG. 1A and depicting an object falling onto and rebounding off of a rotated and canted portion of the accessory.

FIG. 1A and FIG. 1B show a modular pathway apparatus 50 with an accessory 100 arranged thereon, according to some embodiments. As shown, the accessory 100 may be arranged amidst the apparatus 50, it may be secured to a modular member 52 of the apparatus 50, or the accessory may be integral with the apparatus 50. The accessory 100 may be arranged and configured to receive an object or marble 62 following an incoming trajectory 56 as shown in FIG. 2A. The incoming trajectory 56 may be created by an object 62 exiting the apparatus 50 from an elevated location 54, by an object 62 launching from a jump, by an object 62 rebounding from another accessory, by an object propelled 62 by another accessory, or an object 62 otherwise directed toward the accessory 100. The accessory 100 may be configured to deflect, rebound, or otherwise redirect the object or marble 62 along a departing trajectory 58 to a landing location 60 where the object or marble 62 may stay, be collected, or where it may re-enter the pathway apparatus 50 and pass through the apparatus 50 to an end location, for example.

Figure 2B:
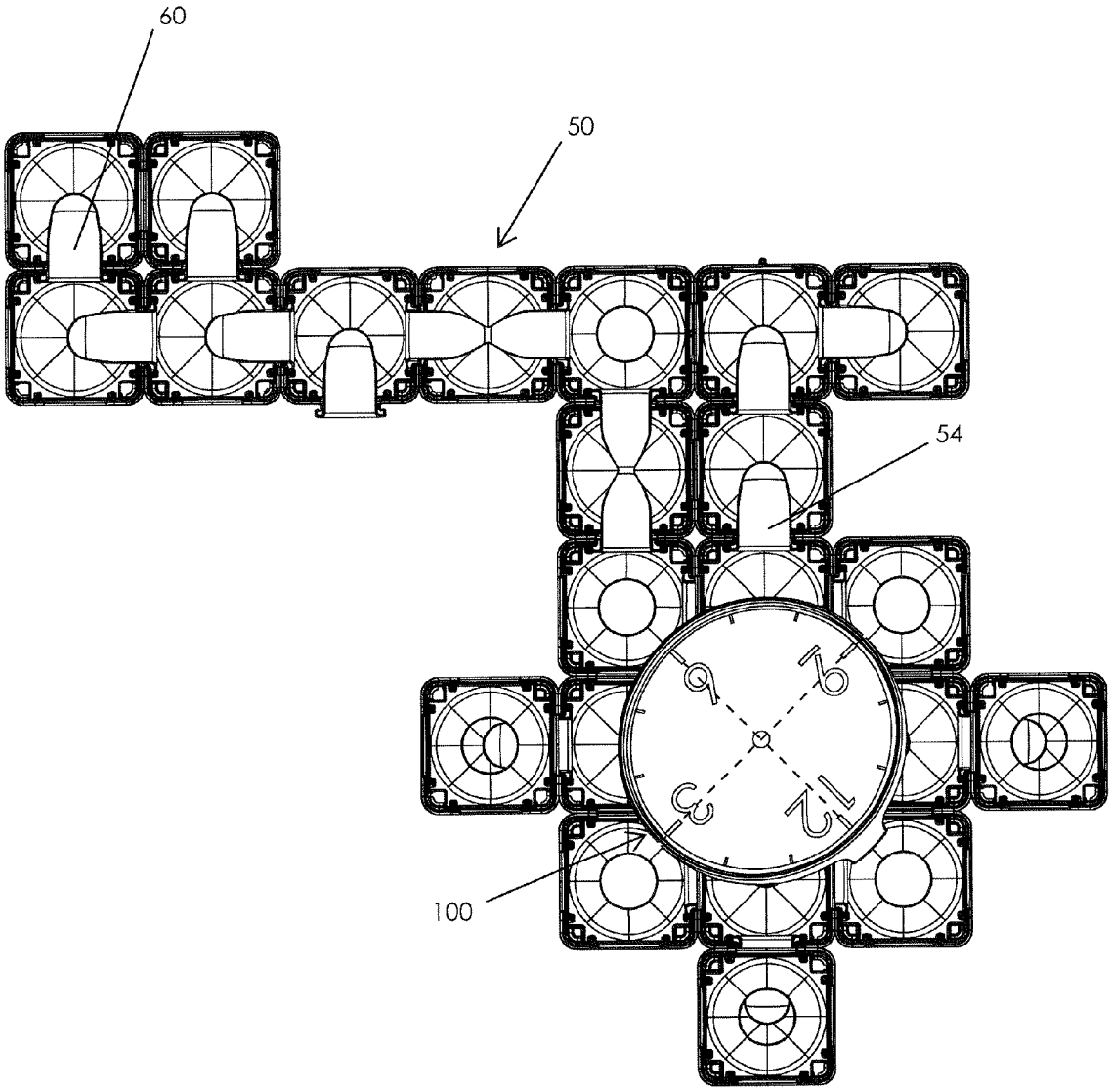
FIG. 2B is a top view of the arrangement shown in FIG. 2A.
Figure 2C:
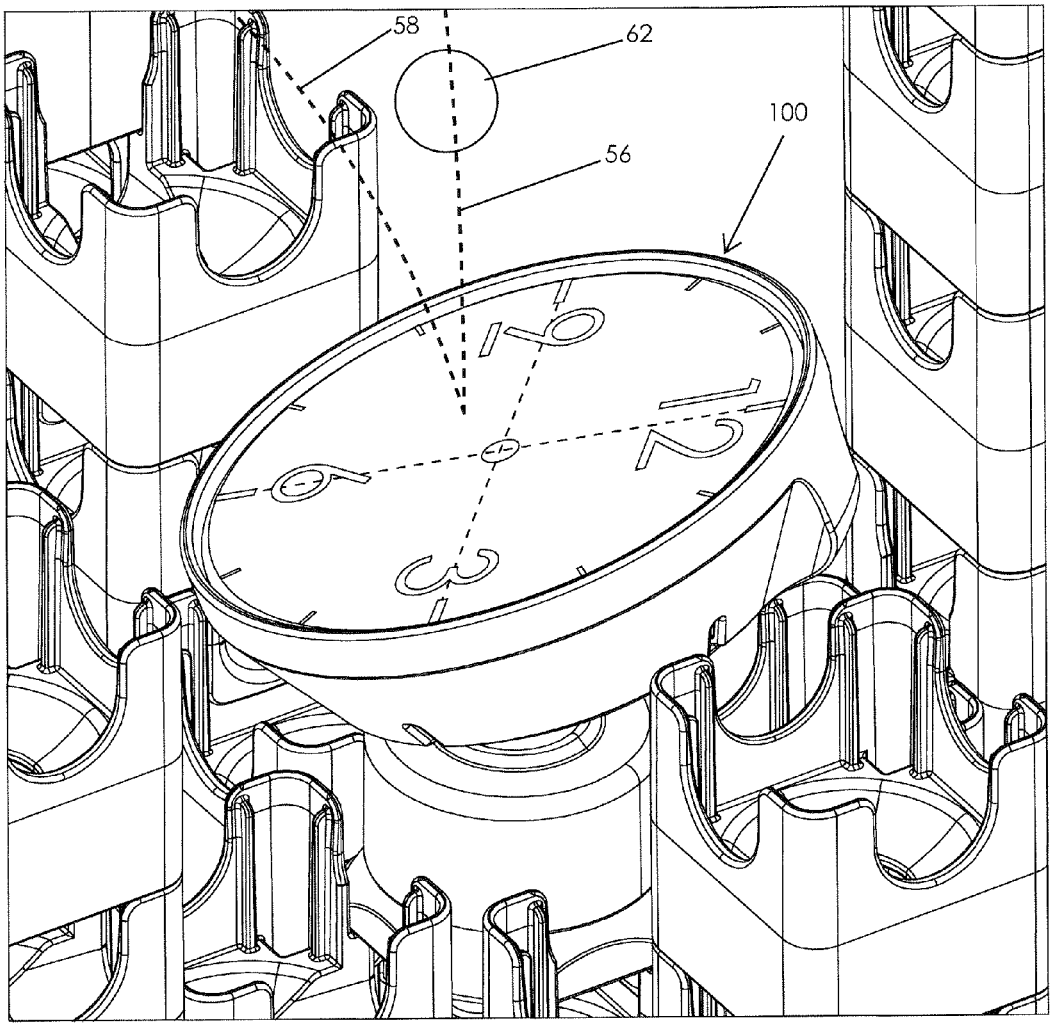
FIG. 2C is a close-up view of the accessory of FIG. 2A.

As will be appreciated by reference to FIGS. 2A and 2B, a portion of the accessory 100 may be configured to be rotated (e.g., about a vertical axis) and it may also be configured to be pivoted (e.g., about a horizontal axis) such that the rebounding surface may be positioned relative to the apparatus 50 to receive and rebound objects or marbles 62 as desired by a user. As can be appreciated by comparing FIG. 1B to FIG. 2B, a portion of the accessory 100 has been rotated approximately 135 degrees clockwise from the orientation shown in FIG. 1B to the orientation shown in FIG. 2B. In addition, by comparing FIG. 1A to FIG. 2A, it can be appreciated that the portion of the apparatus 100 that was rotated has also been pivoted such that the rebounding surface 160 is slightly canted. A close-up view of the position of the rebounding surface 160 is shown in FIG. 2C.

Figure 3A:
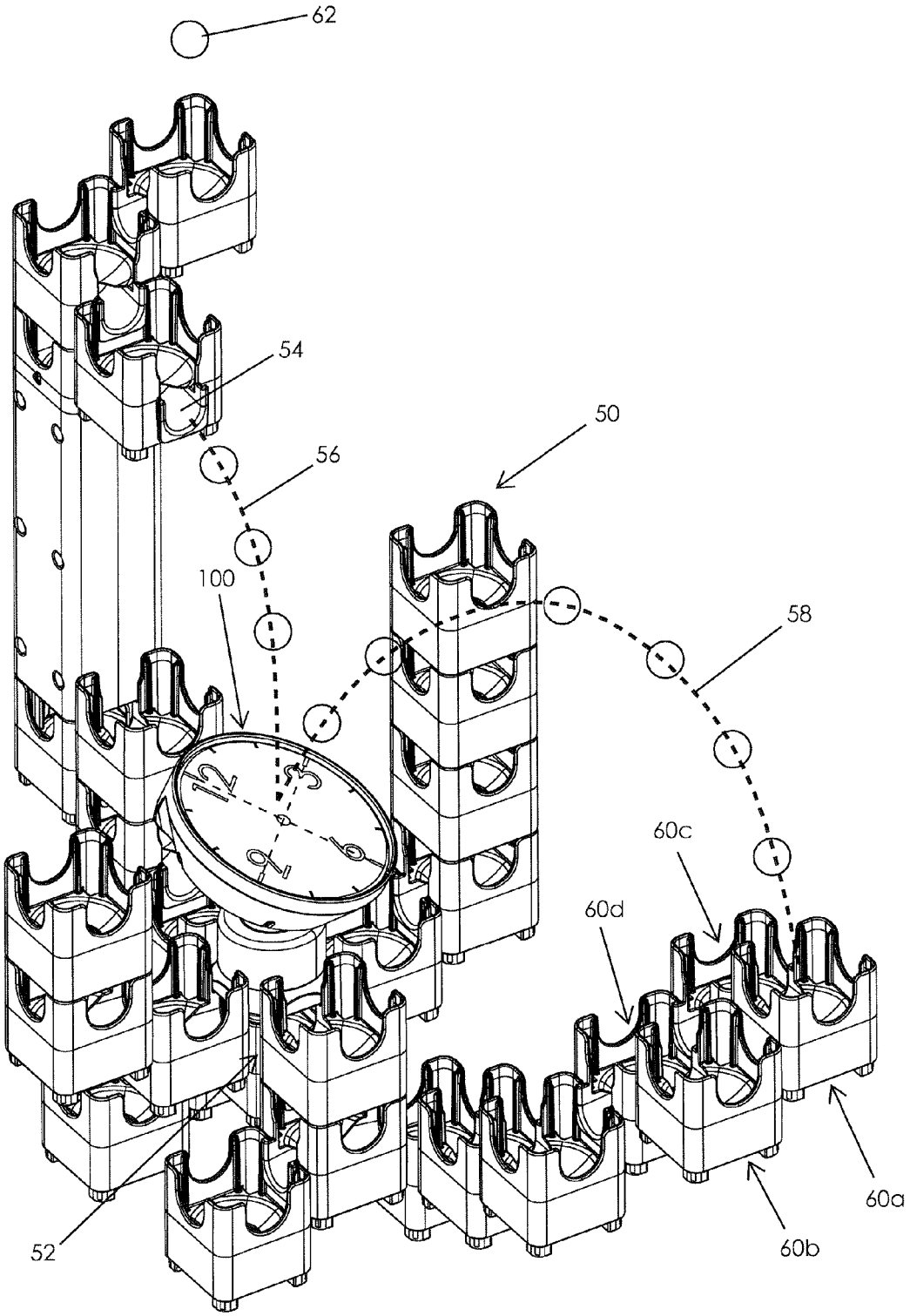
FIG. 3A is a perspective view of the accessory and a partially modified configuration of the apparatus of FIG. 1A and depicting an object falling onto and rebounding off of a rotated and canted portion of the accessory.
Figure 3B:
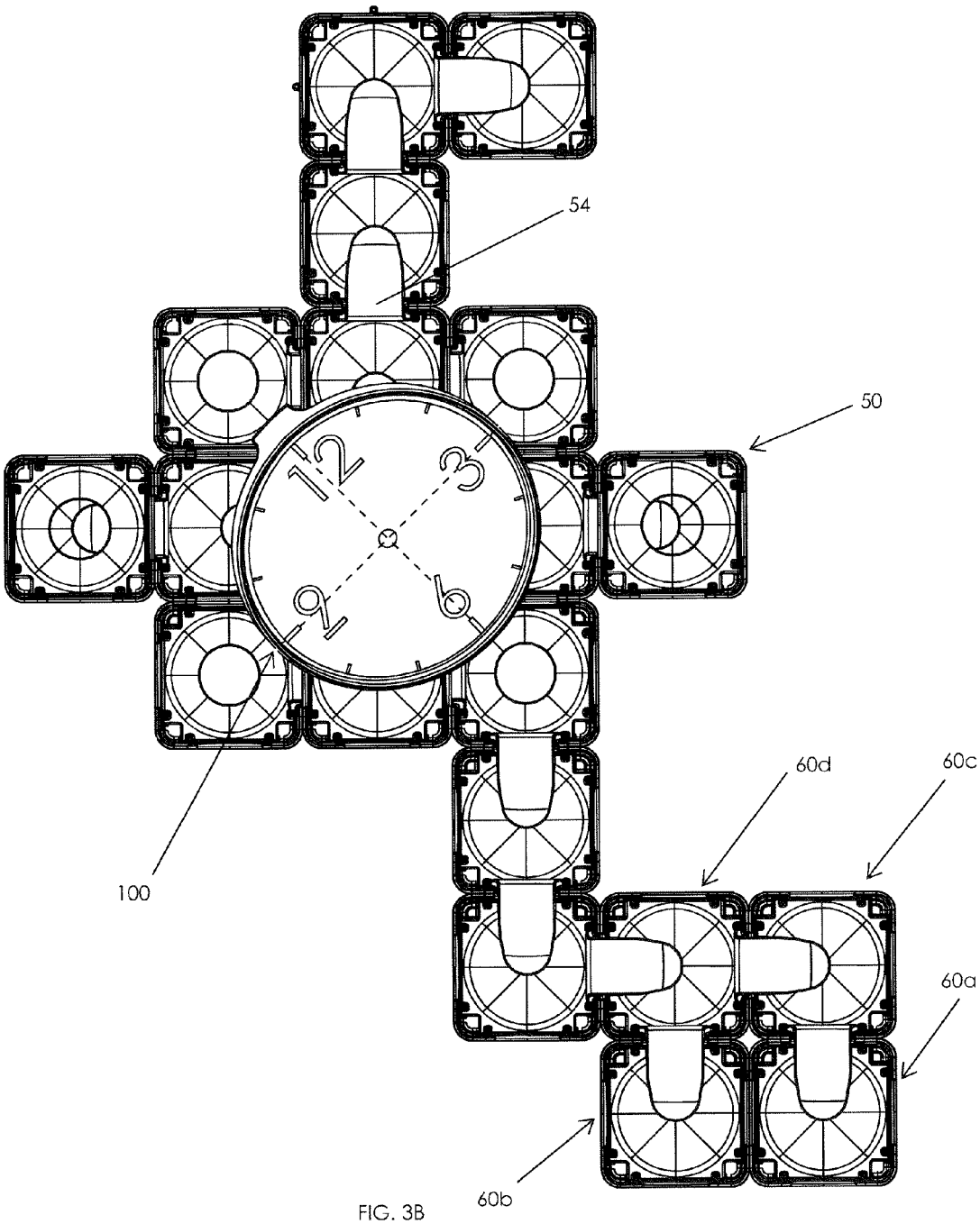
FIG. 3B is a top view of the arrangement shown in FIG. 3A.

In FIGS. 3A and 3B, a portion of the accessory 100 has been rotated approximately 45 degrees counterclockwise relative to the position in FIG. 1A and the portion has also been pivoted such that the rebounding surface 160 is slightly canted. As shown, a landing area 60 different from the landing area in FIGS. 1A and 2A has been created with the modular pathway apparatus 50 to receive objects or marbles 62 departing from the accessory 100.

Turning now to a more detailed view of the accessory 100, reference is made to FIG. 4 showing a perspective view of the accessory 100 arranged on a modular member 52 of a modular pathway apparatus 50. As shown, the accessory 100 may include a rebounding portion 102 for receiving and rebounding objects or marbles 62, a base 104 for supporting the accessory 100 and securing it to a pathway apparatus 50, and an adjustment portion 106 supporting the rebounding portion 102 relative to the base 104 and allowing for the position and/or orientation of the rebounding portion 102 to be adjusted.

Figure 5A:
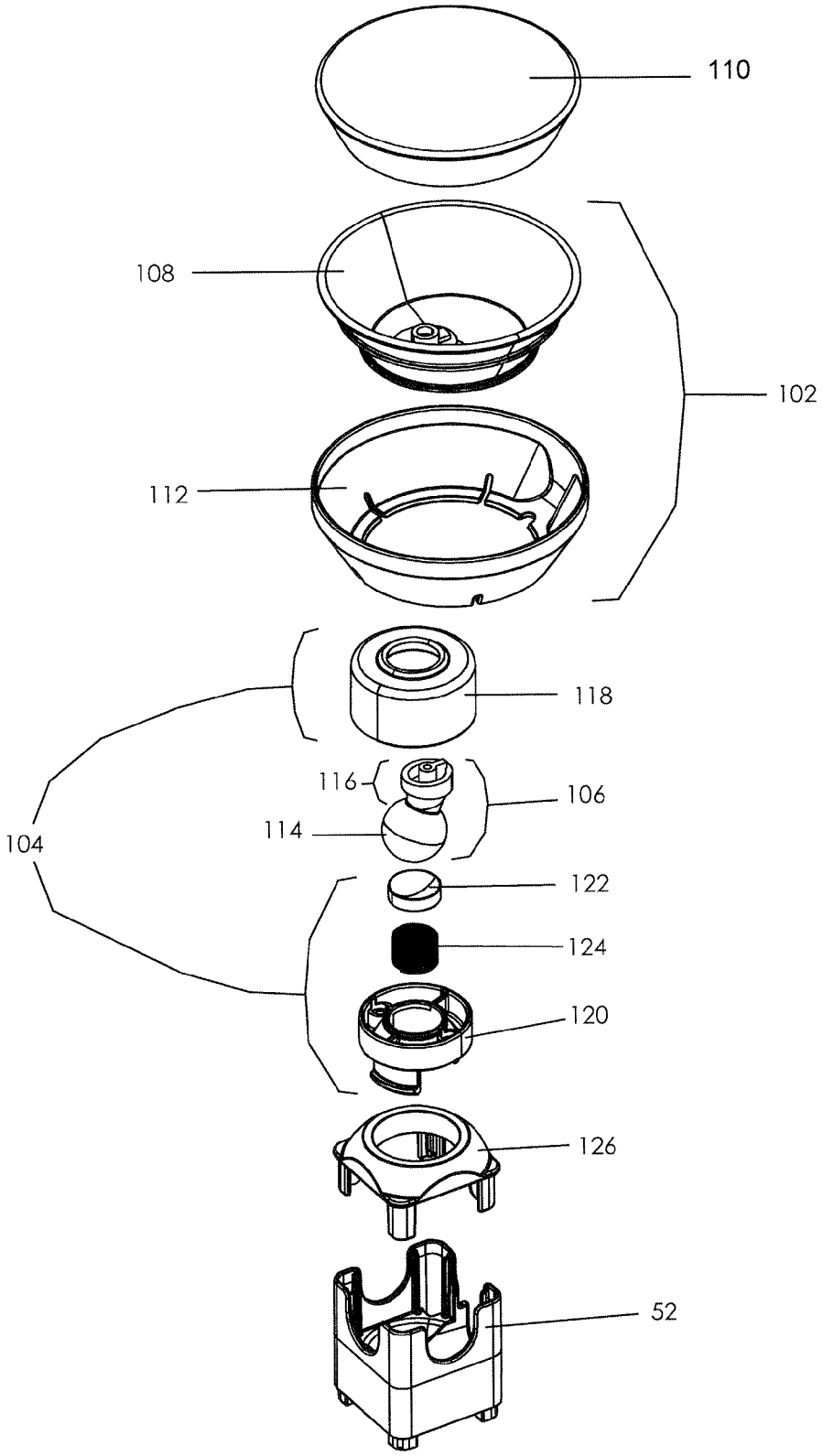
FIG. 5A is a vertically exploded perspective view of the accessory of FIG. 4.
Figure 5B:
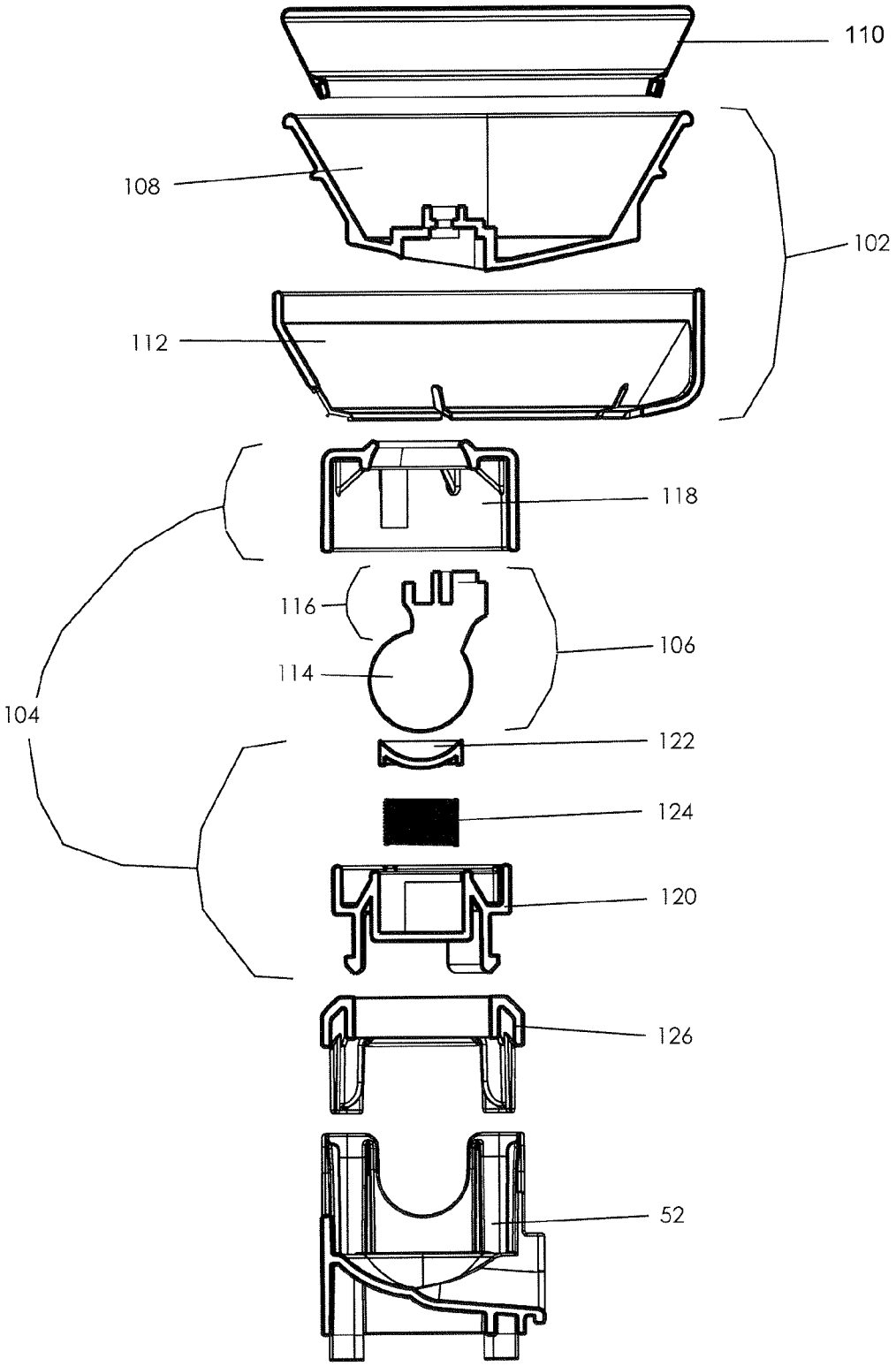
FIG. 5B is a cross-sectional view of the view shown in FIG. 5A.

FIG. 5A is an exploded perspective view of the accessory of FIG. 4 showing the several parts and pieces of each of the rebounding portion 102, the base 104, and the adjustment portion 106 of the accessory 100. FIG. 5B is an exploded cross-sectional view of the accessory of FIG. 4. Each of these portions may include one or more additional parts and pieces.

For example, the rebounding portion 102 may include a frame or stretcher portion 108 and a resilient member or membrane 110 supported by the frame 108. The rebounding portion 102 may also include a cover or sleeve 112 arranged about the outer portion of the frame 108.

The adjustment portion 106 may include a plug 114 configured to be adjustably secured in the base 104 and the adjustment portion 106 may also include a support portion 116 extending from the plug 114 for supporting the rebounding portion 102 relative to the base 104.

The base 104 may include a top cap 118 configured to retain the plug 114 in place in the base 104, a securing portion 120 forming a bottom portion of the base 104 and configured for securing the base 104 to the modular apparatus 50. The base 104 may also include additional components configured for interacting with the plug 114 of the adjustment portion 106. These additional components may include a seat 122 member configured to support a bottom portion of the plug 114 and a biasing mechanism 124 configured for biasing the plug 114 against the top cap 118 of the base 104 to provide frictional resistance to plug motion such as rotational motion and/or pivotal motion.

In addition to the rebounding portion 102, the adjustment portion 106, and the base 104, the accessory 100 may also include a connector portion 126 configured to receive or otherwise secure the securing the portion 120 of the base 104. The connector portion 126 may be further configured to be secured to a modular member 52 of the modular pathway apparatus 50.

Each of the several pieces of the accessory 100 may now be described in more detail. For example, FIGS. 6A-6E show several views of the frame or stretcher portion 108 of the rebounding portion 102 of the accessory 100. The frame or stretcher portion 108 may be configured to provide a substantially rigid framework for support and/or tensioning of the resilient member 110, which is shown in more detail in FIGS. 6F-6K. That is, the frame or stretcher portion 108 may be configured to both support and hold the resilient member 110 in a particular position and/or orientation and may be further configured to maintain the resilient member 110 in a taut condition. As such, the position of the frame or stretcher portion 108 may be adjusted thereby positioning the resilient member 110 providing a rebounding surface upon which an object, or marble 62 for example, may impact the resilient member 110 and be rebounded therefrom in a direction defined by the incoming trajectory 56 of the object 62 and the position of the rebounding surface.

As shown in FIG. 6A-6E, the frame or stretcher portion 108 may include a coupling portion 128 for coupling the frame 108 to the adjustment portion 106. The frame or stretcher portion 108 may also include a spreader or spacer portion 130. The spreader or spacer portion 130 may form the framework for supporting the resilient member 110 and providing separation and space around the resilient member 110 allowing for a suitable amount of deflection in the resilient member 110 to absorb the impact of an object 62 and return this absorbed energy propelling the object 62 from the resilient member 110.

In the present embodiment, the coupling portion 128 and spreader or spacer portion 130 may take the form of a cup or dish where the bottom of the cup or dish form the coupling portion 128 and the walls of the cup or dish form the spreader or spacer portion 130. The cup or dish may have a longitudinal axis 132 extending vertically therethrough defining the center 134 of the bottom and the center 134 of the wall arrangement.

As shown, the bottom of the cup or dish may be in the shape of a broadly shaped cone and it may be generally round when viewed from above extending generally outwardly from the center 134 to a generally circular peripheral edge 136 where it meets the walls. The bottom may include an attachment feature 138 for attachment to the adjustment portion 106 of the accessory 100. It is to be appreciated that a generally flat bottom or a curved bottom or another type of shaped bottom may also be provided and that the bottom may be square, triangular, or some other shape rather than round, for example.

The attachment feature 138 may include a counter-bored area 140 when viewed from the bottom for receiving a fastening portion 142 of the adjustment portion 106. The bore of the counter-bored area 140 may have a longitudinal axis 144 that is substantially parallel to the longitudinal axis 132 of the cup or dish. The counter-bored area 140 may include an additionally recessed slot 146 extending upward from counter-bored area 140 and may be configured to receive a wing or fin 148 on the adjustment portion 106 to resist relative rotation of the frame or spreader portion 108 relative to the adjustment portion 106. An additional bore 150 may extend through the counter-bored area 140 for receiving a fastener and allowing the frame or spreader portion 108 to be fastened to the adjustment portion 106.

The attachment feature 138 may be offset from the center of the bottom of the frame 108. For example, the attachment feature 138 may lie on a circle having a radius ranging from approximately ⅛ to ⅞, ¼ to ⅝, or ⅓ to ½ of the length of the radius of the bottom portion of the frame 108. It is to be appreciated that offsetting the attachment feature 138 may allow the center of the rebounding portion 102 to be adjusted to multiple positions by rotating the rebounding portion 108 relative to the base 104 and without pivoting the rebounding portion 102.

The walls of the cup or dish may extend generally upwardly from the peripheral edge 136 of the bottom and the walls may be tipped outwardly to form a funnel shape having an upper peripheral edge. The upper peripheral edge 152 may define a plane that is generally or substantially orthogonal to the longitudinal axis 132 of the dish or cup. The walls may be relatively thin shell-like structures allowing the peripheral edge to be substantially narrow or thin. It is to be appreciated that the walls may be, alternatively, substantially upright or tipped more drastically outward. However, it is to be appreciated that generally or substantially upright walls may be advantageous in maximizing the rebounding surface area available on the resilient member 110. That is, for example, where the walls are tipped more drastically outward, the resilient member 110 may encroach on the walls near the upper peripheral edge 152 and objects 62 encountering the resilient member 110 near the peripheral edge 152 may cause the resilient member 110 to deflect sufficiently to contact the walls thereby inhibiting the ability of the resilient member 110 to control the rebound trajectory of and/or force on the rebounding object. Still further, a slightly outward tip of the walls may be advantageous in securing the resilient member 110, which is more fully described below.

The upper peripheral edge 152 of the wall may include a peripheral lip 154 arranged along the peripheral edge 152 and extending outwardly away from the center of the dish or cup. The peripheral lip 154 may be configured to reinforce the upper peripheral edge 152 of the frame and may be configured to hold the resilient member 110 clear from contact of the outer surface of the walls when the resilient member 110 is draped over and stretched across the cup and down the outside surface of the walls.

The walls may also include an intermediate lip 156 arranged at an intermediate height of the walls extending along an outer surface of the walls and extending around the perimeter of the walls. The intermediate lip 156 may be adapted for securing the resilient member 110. For example, as shown in FIGS. 6F-6K, a cinch device 158 may be secured to the resilient member 110 and the cinch device 158 may be extended around the perimeter of the walls below the intermediate lip 156. Where the walls are tipped slightly outward, the diameter or other peripheral dimension of the frame 108 may be slightly smaller below the intermediate lip 156 than it is at the intermediate lip 156. Accordingly, as the cinch device 158 is tightened, it may draw the resilient member 110 taut across the dish or cup and down adjacent the outer surface of the walls. The cinch device 158 may be secured against upward propagation by the intermediate lip 156 in addition to the downward tendency of the cinch device 158 due to being tensioned against the sloping surface of the walls.

In some embodiments, the resilient member 110 may be a membranous material that is stretchable allowing for a rebounding surface 160 to be created when the material is stretched over the frame or stretcher portion 108. In some embodiments, the resilient member 110 may be a woven fabric, a net, or other material made from fibers or threads. Still other resilient materials may include elastomeric materials such as neoprene, for example. In still other embodiments, the material may be relatively inelastic and the resiliency may be provided by resilient anchors around the perimeter or at the supporting portions of the material.

As mentioned with respect to the intermediate lip 156 of the frame 108, the resilient member 110 may be secured along its peripheral edge to the frame or stretcher portion 108. In some embodiments, a series of loops, holes, or other anchor features may be provided along the edge of the member 110 for securing the resilient member 110. In some embodiments, a hem may be provided along the edge allowing a cinch device 158 to be threaded therethrough. The cinch device 158 may be an elongate flexible device that may be threaded through the hem and pulled tightly to cinch the resilient member 110 around the frame 108. In some embodiments, the cinch device 158 may be a string, rope, tie, zip tie, wire, or other tension carrying device suitable for threading and for securing one end of the device 158 to an opposite end. In still other embodiments, anchor points may be provided on the frame 108 for securing the opposing ends of the cinch device 158 rather than securing opposite ends to each other. In the case of a zip tie or other cinch device 158 having an enlarged anchor assembly (i.e., zip anchor, knot, etc.), the anchor assembly may be arranged at or near the registration feature 161 described in more detail below. In other embodiments, the enlarged anchor may be arranged at any point around the periphery of the frame 108.

Referring again to FIGS. 6A-6E, the walls may also include a lower lip 162 extending around the periphery of the dish or cup at or near the intersection of the walls and the bottom of the dish or cup. The lower lip 162 may be configured as a stop for the cover 112 when the cover 112 is positioned around the frame or stretcher portion 108. For example, the cover 112 may be placed around the frame 108 from the bottom and may include a flexible portion that may be elastically stretched to pass over the lower lip 162 and once past the lip 162 the flexible portion may snap back into position. The lower lip 162 may then resist downward motion of the cover 112 thereby securing the cover 112 in place on the frame 108.

Figure 6A:
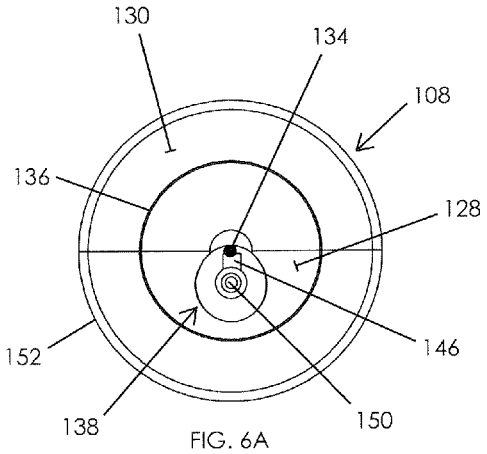
Figure 6B:
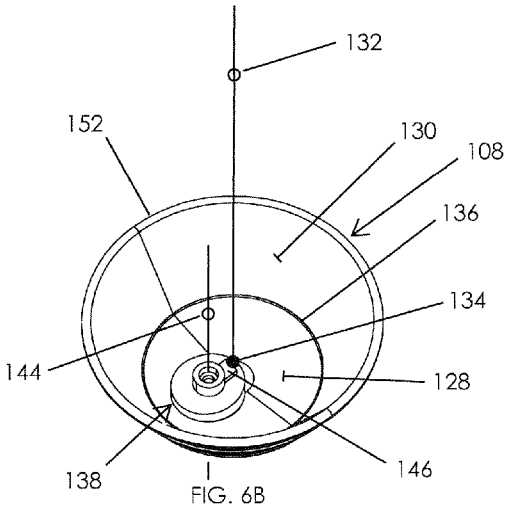
Figure 6C:
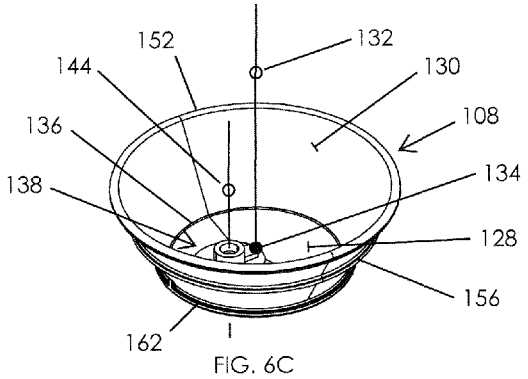
Figure 6E:
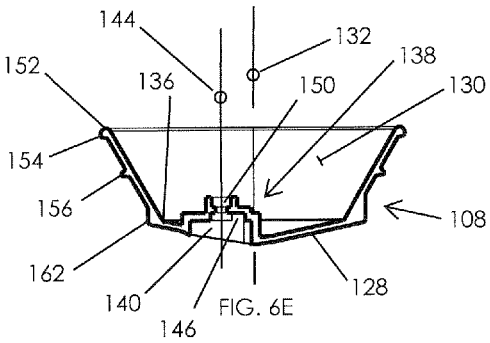
Figure 6D:
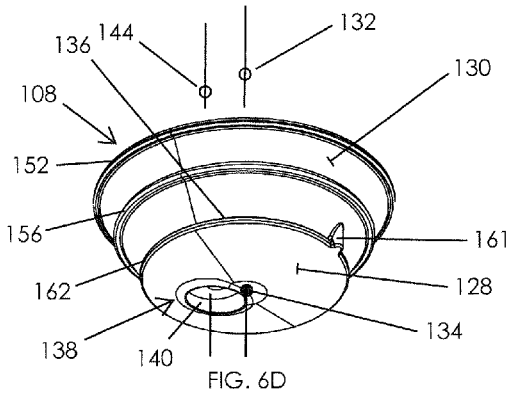
Figure 6F:
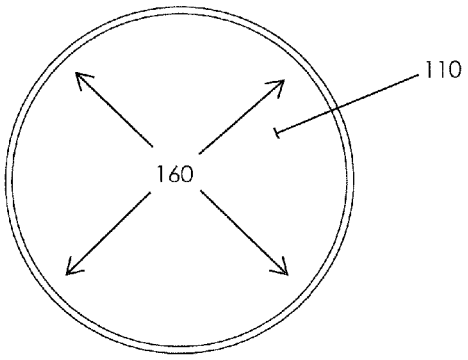
Figure 6G:
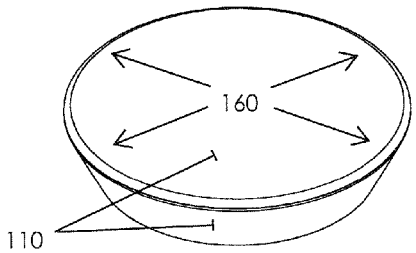
Figure 6H:
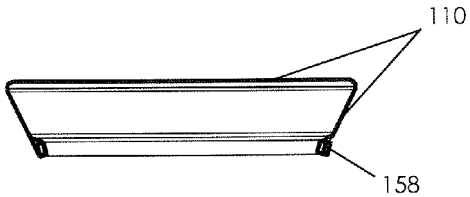
Figure 6I:
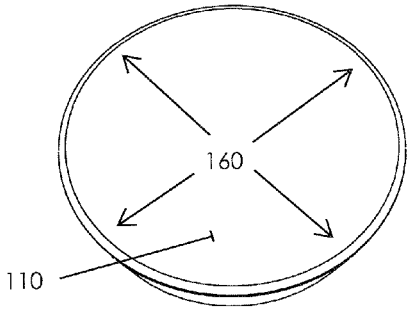
Figure 6J:
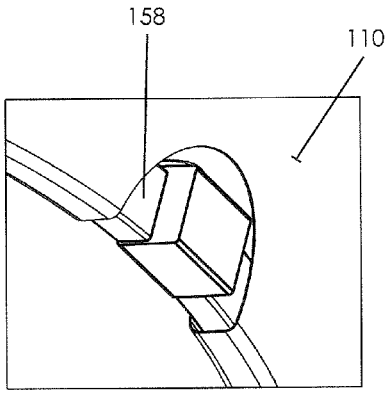
Figure 6K:
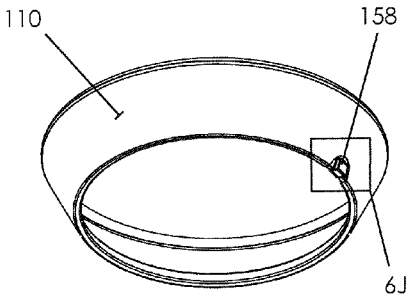
Figure 7A:
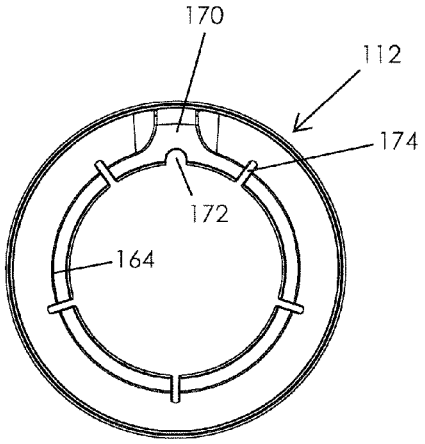
Figure 7B:
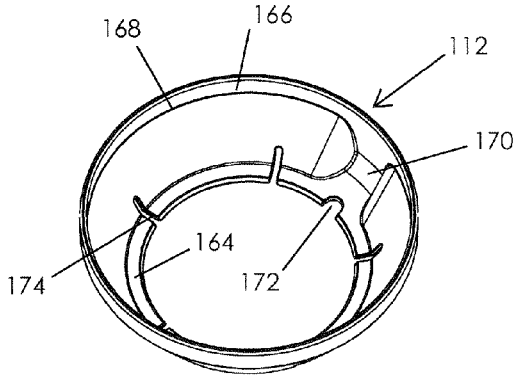
Figure 7C:
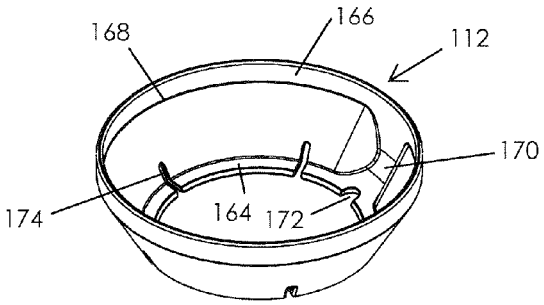
Figure 7E:
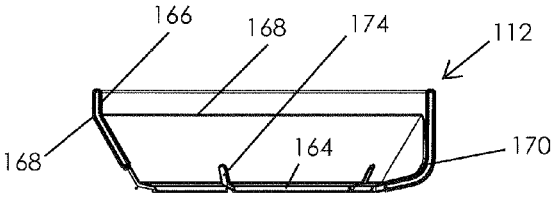
Figure 7D:
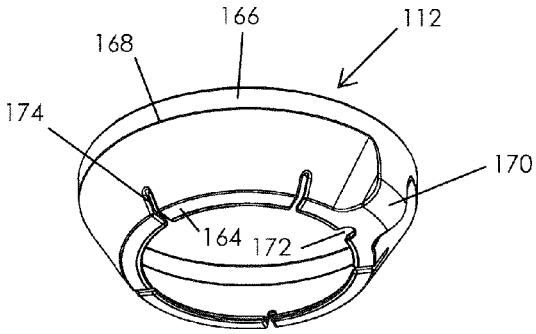

The frame 108 may also include a registration feature 161 for engaging the cover 112 of the accessory 100 and resisting the relative rotation of the cover 112 relative to the frame 108. As shown in FIG. 6D, the registration feature 161 may include an outerwardly extending tab, nub, or rib that is configured to be received by a slit, slot, or recess in the cover 112. The registration feature 161, thus, may engage the cover 112 and resist relative rotation of the frame 108 and cover 112.

Turning now to the cover 112, reference is made to FIGS. 7A-7E. The cover 112 may be configured for arrangement around the frame or stretcher portion 108 for secluding the anchorage of the resilient member 110, providing a clean outer appearance, and for protecting the resilient member 110 against abrasion. In some embodiments, the cover 112 may have a shape that is similar to that of the frame or stretcher portion 108, but the cover 112 may be slightly larger than the frame 108 such that the frame 108 may nest neatly within the boundary of the cover 112. In the embodiment shown, the cover 112 may include a generally conical shape similar to the walls of the frame 108 and it may include a bottom lip 164 projecting inwardly from the bottom portion of the walls. The cover may also include an upper rim that extends substantially upwardly from an upper peripheral edge 168 of the walls. Still further, the cover 112 may include a bump out portion 170 configured to accommodate the enlarged anchor portion of the cinch device 158. The cover 112 may also include a slit, slot, notch, or other recess 172 in the bottom lip 164 for engaging the registration feature 161 on the frame 108. In the present embodiment, the recess 172 for engaging the registration feature 161 may be arranged at or near the bump out portion 170. Accordingly, when the enlarged anchor portion of the cinch device 158 is positioned at or near the registration feature 161 on the frame 108, such may allow the bump out 170 to accommodate the enlarged anchor portion while still allowing the registration feature 161 to engage the associated recess 172 on the cover 112.

As can be seen in the figures, the bottom lip 164 may include one or more elasticity features 174 allowing the bottom portion of the cover 112 to elastically enlarge when it is pressed over the low lip 162 on the frame 108. That is, the cover 112 may be placed on the frame 108 from the bottom side of the frame 108 or, stated another way, the frame 108 may be set into the cover 112 from above. When the frame 108 is set into the cover 112, the low lip 162 on the frame 108 may engage the bottom lip 164 of the cover 112 causing the walls of the cover 112 to flex allowing the bottom lip 164 to expand radially outward. Once the low lip 162 on the frame 108 is pressed past the bottom lip 164 of the cover 112, the bottom lip 164 on the cover 112 may snap into place above the low lip 162. The conical shape of the frame 108 and cover 112 may prevent the cover 112 from propagating further upward along the frame 108 and the low lip 162 may prevent the cover 112 from propagating downward.

As mentioned, the upper peripheral edge 168 of the walls of the cover 112 may include an upper rim 166 extending upwardly from the walls. The upper rim 166 may be adapted to extend above the peripheral edge 168 of the frame 108 so as to provide a raised rim around the perimeter of the rebounding surface portion 160 of the resilient member 110. As such, this upper rim 166 may protect the resilient member 110 against abrasion at a particularly vulnerable location (i.e., where the resilient member 110 is stretched across the peripheral edge 152 of the frame 108). The upper rim 166 may be relatively thin to maximize the surface area of the rebounding surface 160 and reduce the interference of the rim 166 with the surrounding apparatus or structure.

FIGS. 8A-8E show several views of the adjustment portion 106 of the accessory 100. The adjustment portion 106 may include a support portion 116 having a fastening portion 176 and a stem 178 and the adjustment portion 106 may include a plug 114. The fastening portion 176 may be configured for engagement and fastening to the rebounding portion 102 via the attachment feature 138 on the bottom portion of the frame 108. The stem 178 may form a supporting extension between the plug 114 and the fastening portion 176 allowing for clearance between them and aiding in the range of motion available for adjusting the rebounding portion 102. The plug 114 may be configured for adjustable engagement in the base 104 allowing the adjustment portion 106 to be adjusted thereby adjusting the position of the rebounding portion 102.

The fastening portion 176 may be shaped and sized to fit snugly within the counter-bored area 140 of the frame 108. The fastening portion 176 may, thus, be generally cylindrical defining a longitudinal axis 180 and having a diameter slightly smaller than that of the counter-bored area 140. Given the snug fit of the fastening portion 176 in the counter-bored area 140, the longitudinal axis of the fastening portion 176 may be generally parallel to the longitudinal axis 144 of the counter-bored area 140 and, thus, the longitudinal axis 132 of the frame or stretcher portion 108. The fastening portion 176 may also include an upwardly extending fin or wing 148 for engaging the recessed slot 146 in the attachment feature 138 of the frame 108. The engagement of the fin or wing 148 with the recessed slot 146 may resist relative rotation of the frame 108 and the adjustment portion 106. The fastening portion 176 may also include a central bore 182 arranged to be in alignment with the bore 150 in the counter-bored 140 area of the frame 108 such that a fastener may extend through the bores 182/150 and secure the frame 108 and the adjustment portion 106 together. The bores 182/150 may be sized slightly smaller than the fastener such that the threads of a bolt or screw-type fastener may bite into the walls of the bore 182/150 and secure the two parts together.

Figure 8A:
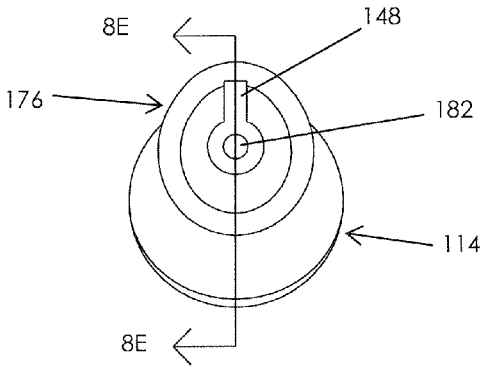
Figure 8B:
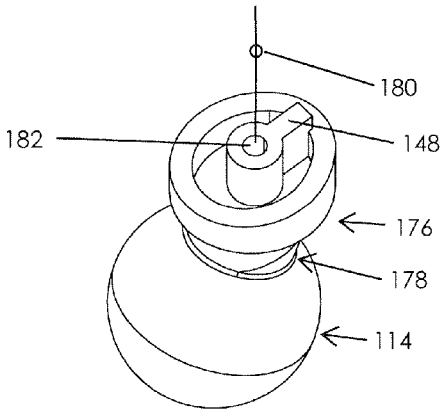
Figure 8C:
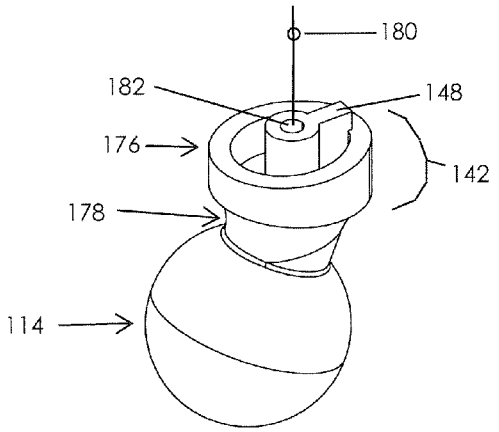
Figure 8E:
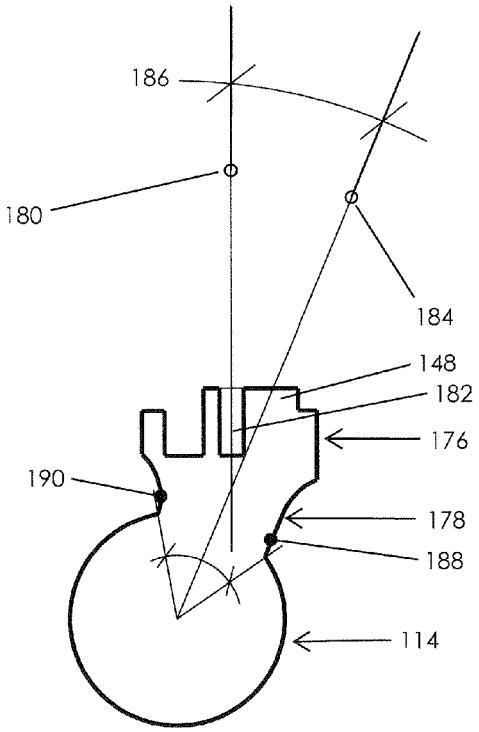
Figure 8D:
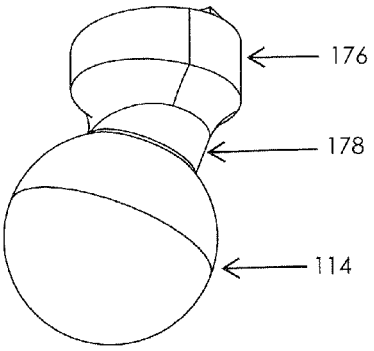
Figure 8F:
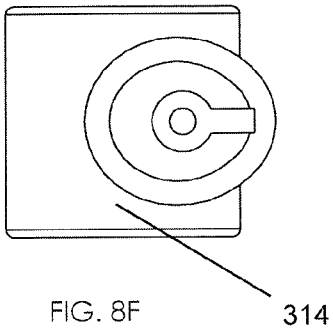
Figure 8G:
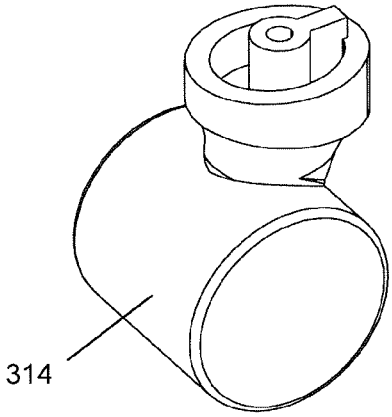
Figure 8H:
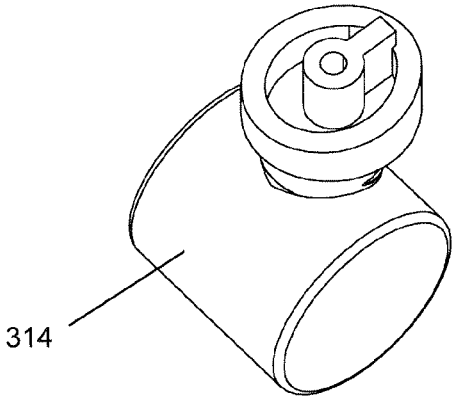
Figure 8J:
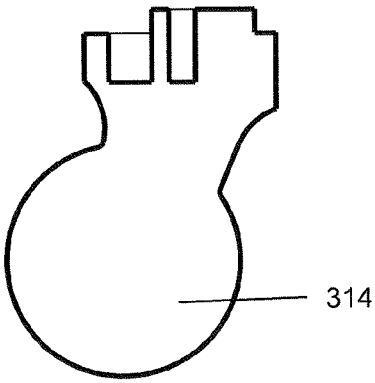
Figure 8I:
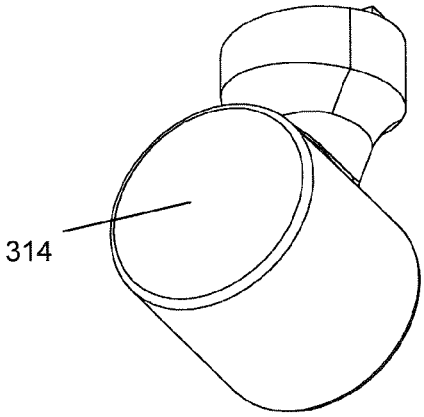

The stem 178 of the adjustment portion 106 may extend downwardly from the fastening portion 176 and may have a longitudinal axis 184 that is skewed relative to the longitudinal axis 180 of the fastening portion 176. As shown in FIG. 8E, for example, the angle 186 between the longitudinal axes 182/150 of the stem 178 and the fastening portion 176 may range from approximately 5 degrees to approximately 60 degrees, or from approximately 15 degrees to approximately 30 degrees, or from approximately 20 degrees to approximately 25 degrees, or the angle may be approximately 22.5 degrees. Still other angles 186 within the ranges mentioned or outside the ranges mentioned may be used.

The stem 178 may be generally cylindrically shaped and may taper slightly as it extends from the fastening portion 176 to the plug 114. At or near the plug 114, the stem 178 may have a diameter defining an outer peripheral surface that may interact with the top cap 118 of the base 104 to define the pivoting range of motion of the stem 178 and, in turn, the range of motion of the rebounding portion 102 of the accessory 100. It is to be appreciated that the cross-sectional view taken in FIG. 8E is taken, as shown in FIG. 8A, through the center of the plug 114 and through the center of the fastening portion 176. This cross-sectional view may be useful in identifying at least two sides of the stem 178 for purposes of a later discussion of the range of motion and degrees of freedom of the accessory 100. For example, the right and left sides of the stem 178 as viewed in FIG. 8E may be referred to as the flat-defining side 188 and the full-cant defining side 190, respectively.

The plug 114 of the adjustment portion 106 may be configured for frictional seated engagement in the base 104 of the accessory 100. The shape of the plug 114 and the associated seat 122 in the base 104 may be selected to provide the desired type and range of motion. Whereas in FIGS. 8A-8E the plug is spherically shaped, in other embodiments, where, for example, pivoting motion (i.e., about a horizontal axis) is desired and rotational motion is not, a cylindrically shaped plug 314 may be provided where the longitudinal axis of the plug is arranged generally horizontally (See e.g., FIGS. 8F-8J). Where rotational motion (i.e., about a vertical axis) is desired and pivoting motion is not, a cylindrically shaped plug may be provided where the longitudinal axis of the plug is arranged generally vertically. Turning back to the present embodiment of FIGS. 8A-8E, the plug 114 may be generally spherically shaped to allow for both rotation and pivotal motion of the plug 114 and the corresponding stem 178 and rebounding portion 102. It is to be appreciated, however, that a spherical plug 114 may be in the shape of a sphere or the portions of the plug 114 that engage with the base 104 may be generally spherically shaped. However, portions of the plug 114 not coming into contact with or engaging 104 the base, may be omitted or otherwise shaped, for example. In still other embodiments, the plug 114 may be oblong, oval, elliptical, or another shape providing for different types of motion involving pivoting, rotation, or a combination thereof.

It is to be appreciated that not only can differently shaped plugs 114 be provided, but a different adjustment motion mechanism may also be provided. For example, with reference to the FIGS. 21-23, an embodiment is shown with a hinge mechanism made up of a center portion 914 and a pair of hinge plates 1008A and 1008B. The center portion 914 may be arranged in a base portion 904 between the hinge plates 1008A and 1008B. The hinge plates 1008A and 1008B may extend from a securing portion 1020 that is adapted similarly to the securing portion 120, described in more detail below. The hinge plates 1008A and 1008B may include a hole for passing a shaft 922 therethrough. The shaft may rest in and be supported by each of the holes of the hinge plates 1008A and 1008B and the shaft may extend along a longitudinal axis of the center portion 914. The holes in the hinge plates 1008A and 1008B may be offset from a surface of the base 904 by at least half of the diameter of the center portion 914 so as to hold the center portion 914 clear from the surface of the base. As such, the shaft 922 may support the center portion 914 relative to the base 904 and allow the center portion 914 to pivot about the horizontal axis of the shaft and relative to the base 904. The shaft may include a knurled nut 924 arranged on one end thereof that is adapted to be loosened and tighten and, when tightened, the clamping force of the hinge plates 1008A and 1008B on the center portion 914 is increased thereby securing the center portion 914 and the associated stem and rebounding portion 102 in a selected position based on a frictional force therebetween. The nut 924 may be loosened and retightened each time a new pivoted position is desired or the nut 924 may be tightened to allow pivotal movement of the center portion 914 with some force, while maintaining the position of the center portion 914 during use or when objects or marbles 62 contact and rebound from the rebounding portion 102.

It is to be appreciated that still other arrangements may be provided such as, for example, a pivotal portion that includes a left cylindrical portion and a right cylindrical portion that meet at their circular faces. (i.e., one may nest within the other) Friction between the two faces of the cylindrical halves may allow for the position of the adjustment portion 106 to be held. For example, a screw and wing-nut or other fastening mechanism may be provided extending along the longitudinal length of the cylindrical halves to create a frictional force between the semi-circular faces at the ends of the plug.

Figure 9A:
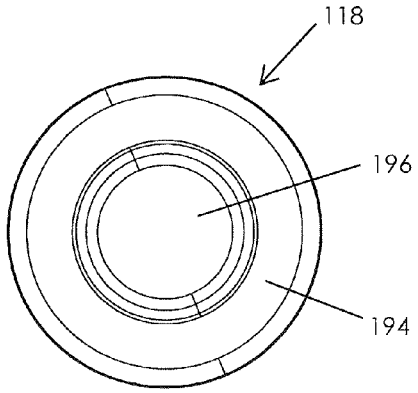
Figure 9B:
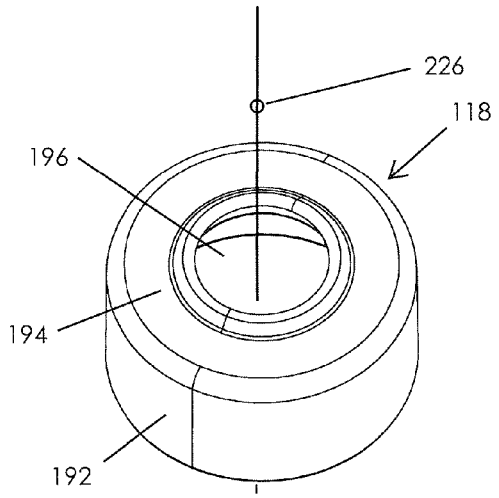
Figure 9C:
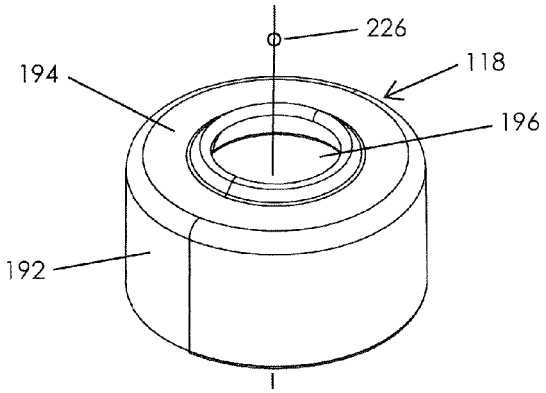
Figure 9E:
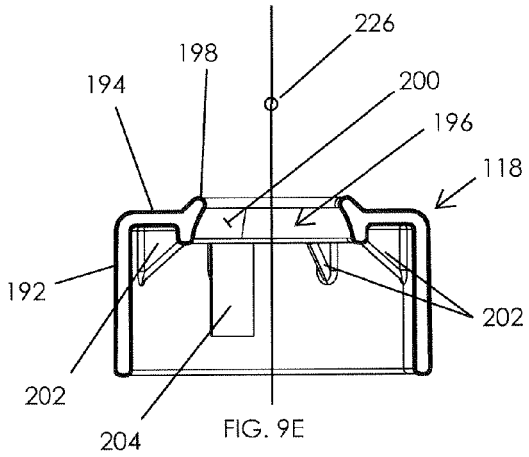
Figure 9D:
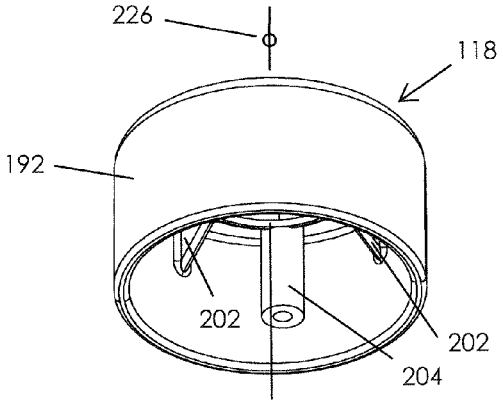
Figure 10A:
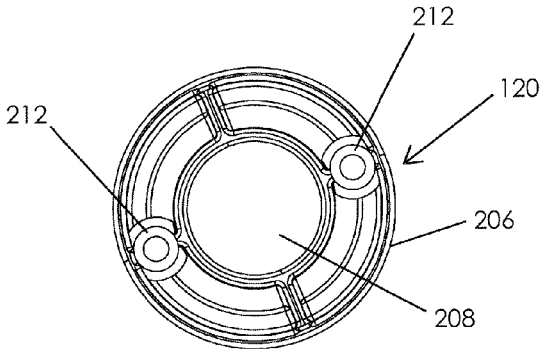
Figure 10B:
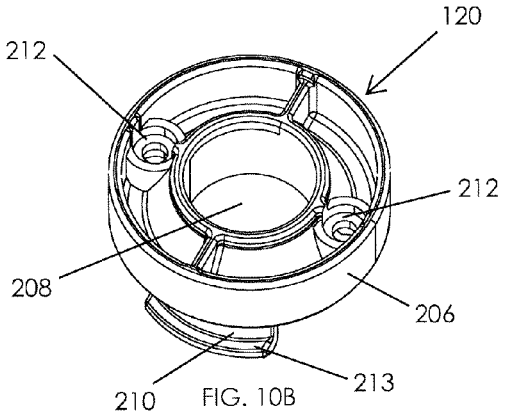
Figure 10C:
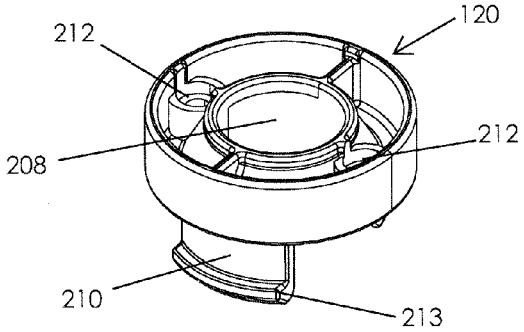
Figure 10E:
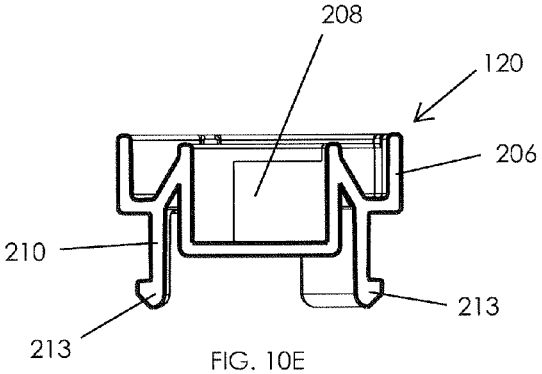
Figure 10D:
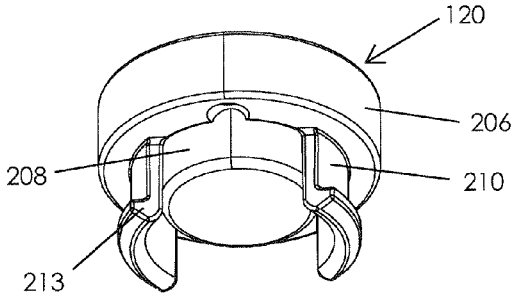
Figure 11A:
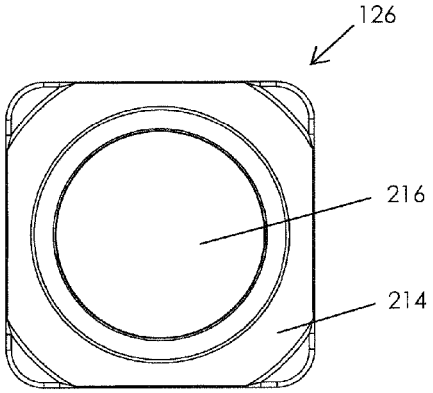
Figure 11B:
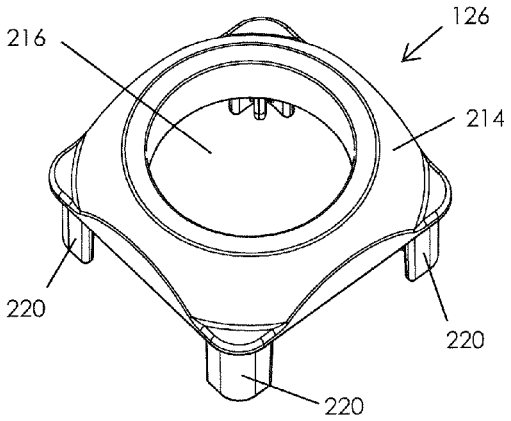
Figure 11C:
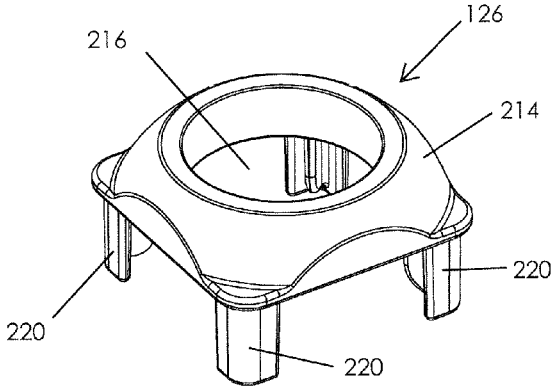
Figure 11E:
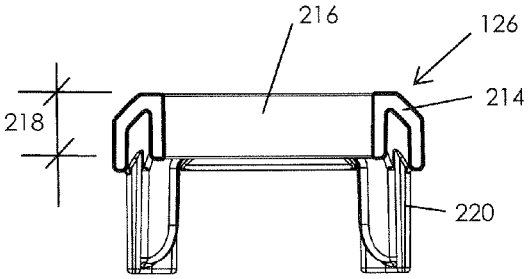
Figure 11D:
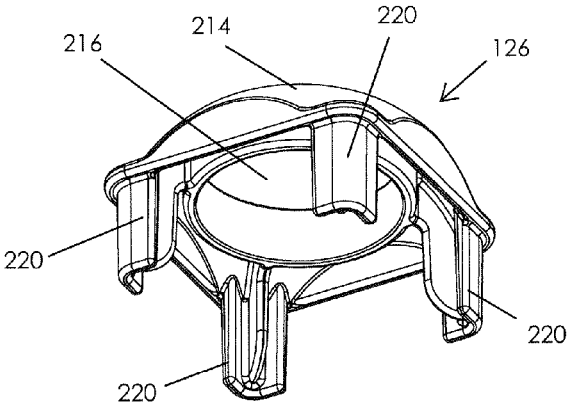
Figure 12A:
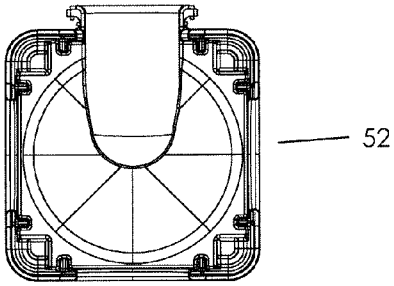
Figure 12B:
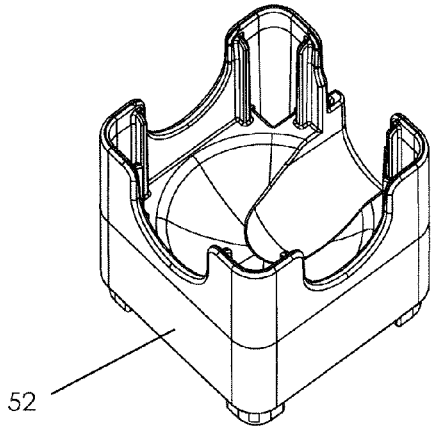
Figure 12C:
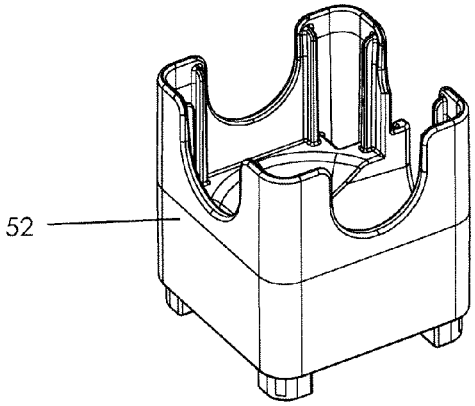
Figure 12E:
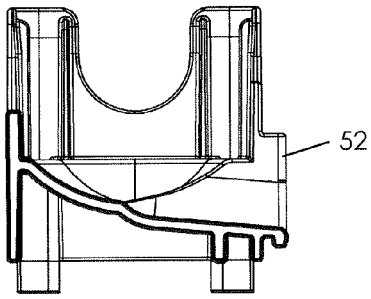
Figure 12D:
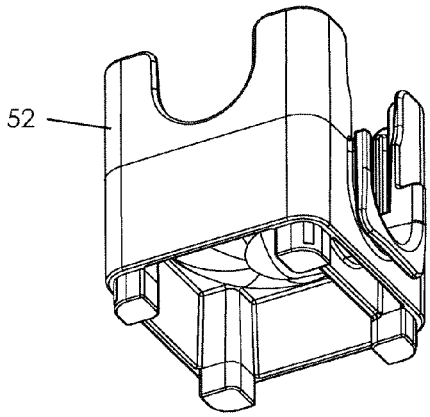

Turning now to the base 104, reference is made to FIGS. 9A-9E, showing several views of the top cap 118 of the base 104. The top cap 118 may include a peripheral housing 192 and a top 194. The top 194 may include an opening 196 providing for the stem 178 of the adjustment portion 106 and a portion of the plug 114 to project out of the base 104. The top 194 may include a retainer 198 arranged along a perimeter of the opening 196 and adapted to nestably retain the plug 114 in the base 104. As shown, the retainer 198 may be continuous around the perimeter of the opening 196. In alternative embodiments, the retainer 198 may be discontinuous and intermittent for example. As shown in FIG. 9E, the retainer 198 may have a cross-section adapted to conformingly abut a top portion of the plug 114. In the present case, where the plug 114 is spherical, the retainer 198 may have cross-section with an abutting surface 200 that is substantially concave and has a radius substantially equal to the radius of the spherical plug 114. As will be discussed in more detail below, the plug 114 may be biased upwardly against the retainer 198 such that the plug frictionally and smoothly engages retainer 198 while being prevented from exiting the top cap 118 of the base 104.

The biasing force on the plug 114 may create an upward force on the retainer 198 and, as such, a plurality of stiffeners 202 may be provided on the underside of the top 194 of the top cap 118 thereby strengthening the tops resistance to out-of-plane deformation. In addition, the top cap 118 may include one or more fastener elements 204 for receiving a fastener and hold the top cap portion 118 to the securing portion 120 or bottom portion of the base 104. The fastener element 204 may include a protrusion on an inner surface of the housing 192 having a bore extending therethrough for receiving a fastener.

The securing portion or bottom portion 120 of the base is shown in FIGS. 10A-10E. The securing portion 120 may include a peripheral housing 206, a biasing mechanism holding area 208, and an anchoring device 210. The peripheral housing 206 may be configured to align with the housing 192 of the top cap 118 such that when the top cap 118 and the bottom portion 120 are secured to one another, the outer surface may be generally smooth across the seam between the two parts. Within the housing 206, the bottom portion 120 may include a fastening feature 212 configured to engage the fastening features 204 on the top cap 118 and may include a bore to be aligned with the bore in the corresponding feature 204 in the top cap 118. A fastener may be provided to secure the top cap 118 and the bottom portion 120 together.

The biasing mechanism holding area 208 may be arranged within the housing 206 and may include a cylindrical recess or other defined area for holding a biasing mechanism 124. In the present embodiment, the holding area 208 may include a generally cylindrical area adapted to maintain a spring in a central location below the plug 114 of the adjustment portion 106. As such, the holding area 208 may be generally centered relative to the opening 196 in the top 194 of the top cap 118 of the base 104. The holding area 208 may have a diameter slightly larger than the biasing mechanism 124 such that the biasing mechanism 124 may expand and contract without resistance from the holding area 208, but the holding area 208 may generally maintain the position of the biasing mechanism 124. The holding area geometry and size may also be configured for receiving and guiding the plug seat 122, which may be arranged between the biasing mechanism 124 and the plug 114. While the biasing mechanism 124 has been described as a spring, other biasing mechanisms 124 such as pressurized balloons, rubberized cores or cylinders, or other biasing mechanisms 124 may be provided. The bottom of the holding area 208 may be spaced from the retainer 198 of the top cap 118 by a distance selected to maintain the biasing mechanism 124 in a compressed condition such that the plug 114 is continuously maintained in a contacting position with the retainer 198.

Referring back to FIGS. 5A and 5B and also to FIG. 13A, one embodiment of a biasing mechanism 124 and a seat 122 is shown. In the present embodiment, the biasing mechanism 124 is a spring. The seat 122 is configured to ride on the top surface of the biasing mechanism 124 and provide nested abutting surface upon which the plug 114 of the adjustment portion 106 may rest. As shown, the seat 122 may include generally cylindrical perimeter portion configured to slidably translate along the height of the holding portion 208 of the base 104. As such, the outer diameter of the seat 122 may be slightly smaller than the diameter of the holding portion 208. The seat 122 may also include a concave surface for nestably engaging the bottom of the plug 114. The surface may extend generally across the width of the seat 122 and may be in the form of a concave plate or a series of curved ribs or another structure for forming a concave structure. In the present embodiment, the concave surface may be generally spherical and may have a radius substantially equal to the radius of the outside surface of the plug 114. The holding area 208 may have a depth sufficient to maintain the seat 122 centered under the plug 114 when the plug 114 is abutting the retainer 198 on the top cap 118 of the base 104.

It is to be appreciated that alternative embodiments may rely on the fastening force between the top cap portion 118 and the securing portion 120 to create the frictional resistance to motion of the plug 114. That is, in some embodiments, the biasing mechanism may be omitted and a seat may be provided in the base as a separate element or as an element integral with the base. The fastening system for securing the top cap 118 to the securing portion 120 may be sized such that when fastened, a pinching and/or squeezing force grips the plug 114 of the adjustment portion 106 creating a frictional resistance to motion of the plug 114. In still other embodiments, while the top cap 118 and the securing portion 120 have been described as being directly fastened to one another in an abutting relationship, it is to be appreciated that these two parts could be threaded together by providing threads around their respective perimeter surfaces that engage one another and allow for some adjustment of the positions of the two members relative to one another. As such, the pinching or squeezing force on the plug may be adjusted. Still further, this latter embodiment that includes the ability to adjust the position of the top cap 118 relative to the securing portion 120 may be provided together with an internal biasing mechanism 124 as well. As such, the adjustment of the top cap 118 and the securing portion 120, based on a given biasing mechanism, may allow for the compressive force on the biasing mechanism and, thus, the resulting biasing force to be adjustable.

Continuing with the discussion of the bottom portion of the base 104, FIGS. 10A-10E show an anchoring device 210 projecting downward from the peripheral housing 206. The anchoring portion 210 may include a pair of opposed flexible extensions with outwardly projecting tabs 213 at the bottom edge. The opposed flexible extensions may be inserted into an opening of another member. The opening may have a diameter smaller than the dimension of the outwardly projecting tabs 213. As such, as the extensions are inserted, the extensions may deflect allowing the tabs 213 to pass through the opening. When the tabs 121 reach the other side of the opening, the flexible extensions may snap back into place causing the projecting tabs 213 to slip behind the boundary of the opening and secure or anchor the device to the other member with the opening.

FIGS. 11A-11E show an embodiment of a universal connector 126. The connector 126 may be adapted to receive the anchoring device 210 of the accessory 100 described, or it may receive an anchoring device of another type of accessory 100. The connector 126 may be further adapted to engage a modular member 52 of the modular pathway apparatus 50 thereby allowing for the attachment of a variety of accessories 100 to be secured to a modular member 52.

The connector 126 may include a top portion 214 with an opening 216 for receiving an anchoring device 210. The top portion 214 may include an opening 216 having a size slightly larger than the clear distance between the projecting tabs 213 of an anchoring device 210 and slightly smaller than the out-to-out distance between the outer surfaces of the projecting tabs 213. The opening 216 may include a bore extending into the connector 126 with a length 218 substantially equal to the length of the flexible extensions of the anchoring device 210. As such, when the anchoring device 210 is inserted into the connector 126, the engagement of the projecting tabs 213 with the inner wall of the bore will cause the flexible extensions on the anchoring device 210 to flex until the anchoring device 210 is fully inserted and the projecting tabs 213 exit the opposing end of the bore where the flexible extensions snap back to their neutral position causing the projecting tabs 213 to hook onto the opposing end of the bore. In some embodiments, the opposing end of the bore may have rotational blocks arranged to receive the projecting tabs 213 therebetween thereby preventing relative rotation of the anchoring device 210 and the connector 126. In such embodiments, the bottom portion 120 may be prevented from rotating with respect to the connector 126. In other embodiments, the opposing end of the bore may not have rotational blocks such that the bottom portion 120 may be free to rotate relative to the connector 126 along the axis 226. In embodiments where the plug 114 is a cylinder, for example, having a horizontal longitudinal axis, the rebounding portion 102 may have at least two degrees or rotational freedom (i.e., pivotal motion about the horizontal axis of the plug 114 and rotational motion about axis 226 by way of rotation of all of the rebounding portion 102, the base 104, and the adjustment portion 106 relative to the connector 126.

The connector 126 may also include a plurality of legs 220 configured and shaped for securing the connector 126 to a modular member 52. In the present embodiment, the connector 126 may include a leg 220 in each of the four corners of the connector 126 adapted to frictionally and sleevably engage the inner four corners of a modular member 52 such as the one shown in FIGS. 12A-12E. Additional examples of modular members may be found, for example in U.S. patent application Ser. No. 12/406,824 entitled Interconnecting Modular Pathway Apparatus, filed on Apr. 18, 2006, the content of which is hereby incorporated by reference herein in its entirety.

It is to be appreciated that, in some embodiments, the connector 126 may be omitted and features for engaging a modular member 52 may be integrally formed with the base 104. As shown in FIGS. 18-20E a base 704 may be provided that incorporates several of the features of the connector 126 into a securing portion 720 of a base 704. For example, as shown, the securing portion 720 may include a peripheral housing 806 and a biasing mechanism holding area 808. In this embodiment, the peripheral housing 806 may be configured to sleevably engage the peripheral housing 192 of the top cap 118. Within the housing 806, the bottom portion 720 may include a fastening feature 812 configured to engage the fastening features 204 on the top cap 118 and may include a bore to be aligned with the bore in the corresponding feature 204 in the top cap 118. A fastener may be provided to secure the top cap 118 and the bottom portion 720 together.

The biasing mechanism holding area 808 may resemble the holding area 208 of the securing portion 120 and the biasing mechanism 724 and the seat 722 may also resemble the mechanism 124 and seat 122 of the securing portion 120. However, in lieu of the anchoring device 210 show on the securing portion 120, the securing portion 720 may instead include a plurality of legs 820 configured and shaped for securing the connector base 704 directly to a modular member 52. Like the connector 126, the securing portion 720 may include a leg 820 in each of the four corners of the securing portion 720 adapted to frictionally and sleevably engage the inner four corners of a modular member 52 such as the one shown in FIGS. 12A-12E and FIGS. 18 and 19.

Returning now to the initially introduced embodiment, FIGS. 13A-13C, show the rebounding portion 102 in a series of pivoted positions. In FIG. 13A, the rebounding portion 102 is positioned such that the rebounding surface 160 is in a substantially horizontal, or flat, or uncanted position. In FIG. 13B, the rebounding portion 102 is positioned such that the rebounding surface 160 is partially canted, and in FIG. 13C, the rebounding portion 102 is fully canted. An additional view of these positions is shown in FIG. 13D where these positions are superimposed on a single figure. The range of pivoting motion of the rebounding portion 102 may be controlled by the size of the receiving opening 196 in the base 102 and the width of the stem 178 of the adjustment portion 106.

For example, in FIG. 13A, the rebounding portion 102 is in a substantially horizontal or flat position relative to a vertical direction, where vertical is defined by the accessory's interaction with the modular member 52 and/or the vertically extending sides of the housing 192 of the base 104 of the accessory 100. It is to be appreciated that the cross-sectional views taken are similar to that of FIG. 8E in that they are taken through the center of the plug 114 and the center of the fastening portion 176. As shown, and as shown in a close-up view in FIG. 13E, the flat-defining side 188 of the stem 178 is in an abutting relationship with the retainer 198. In contrast, in FIG. 13C, the full-cant-defining side 190 of the stem 178 is in an abutting relationship with the retainer 198 and the rebounding surface 160 is in a fully canted or sloped position relative to the vertical direction previously defined.

The opening 196 in the top cap 118 of the base 104 and the size of the stem 178 may, in part, determine the range of motion of the rebounding portion 102. In the present embodiment the included angle 222 of the opening around which the retainer 198 extends may be approximately 105 degrees. The included angle 224 of the stem 178 may be approximately 60 degrees, and, thus, the remaining amount of the opening's included angle 222 that is available for motion of the adjustment portion 106 may be approximately 45 degrees. As such, in some embodiments, the full-cant position of the rebounding portion 102 may be such that the rebounding surface 160 is angled at approximately 45 degrees. Still other amounts of included angle may be provided. It is to be appreciated that the retainer 198 may be less effective in retaining the plug as the included angle of the opening 196 approaches 180 degrees, but included angles 222 ranging from approximately 60 degrees to approximately 150 degrees, or from approximately 90 degrees to approximately 115 degrees or from approximately 100 degrees to approximately 110 degrees may be provided. Still other angles 222 inside or outside the ranges mentioned may be provided. Moreover, the included angle 224 of the stem 178 may depend on the type of material used to make the stem 178 together with considerations relating to the desired strength of the stem 178. The included angle 224 of the stem may range from approximately 10 degrees to approximately 110 degrees, or from approximately 45 degrees to approximately 90 degrees, or from approximately 55 degrees to approximately 65 degrees. Still other angles inside or outside the ranges mentioned may be provided. In some embodiments, the range of motion of the rebounding portion 102 may be determined by subtracting the included angle of the stem 224 from the included angle 222 of the opening 196.

As can be appreciated by a review of the present application, a very high level of flexibility is provided for the position of the rebounding portion 102 of the accessory 100. As shown in the early figures, the rebounding portion 102 may have a center that is offset from the center of the base 104 when viewed from above allowing the rebounding portion 102 to be rotated about a vertically extending longitudinal axis 226 of the base 104 defining a wide array of positions relative to the base 104 that are available for positioning of the rebounding portion 102. Still further, as most recently described with respect to FIGS. 13A-13E, the rebounding portion 102 may be pivoted through a range of motion about a pivot axis 228 extending through the center of the plug 114 and perpendicular to the longitudinal axis 180 of the fastening portion 176 and perpendicular to the axis 184 of the stem 178 (i.e., the pivot axis 228 may include the axis extending in and out of the page of FIG. 13E). However, due to the multiple degrees of freedom of the motion of the rebounding portion 102, yet another rotation may be performed. For example, the first rotation (i.e., about axis 226 of base) may be provided and the pivoting motion (i.e., about pivot axis 228) may be added thereto to create a desired angle of the rebounding surface 160 in a first direction. Moreover, without adjusting the first rotation angle or the second pivot position, the rebounding portion 102 may be further rotated about the axis 184 of the stem 178. Accordingly, the accessory provided may include three rotational degrees of freedom. Within those degrees of freedom, the horizontal rotation 184 (i.e., about axis 226) may include a full 360 degree range of motion. Rotating about the axis of the stem 178 also includes a full 360 range of motion. Pivoting the rebounding surface 160 about the axis pivot 228 may have a range of motion ranging from approximately 15 degrees to approximately 110 degrees or from approximately 30 degrees to approximately 60 degrees, or from approximately 40 degrees to approximately 50 degrees, for example. Accordingly, a rotatable and positionable trampoline device may be provided that is easy to use and easily positionable and/or rotatable that automatically holds its adjusted position without further attention and maintains such position after impact by a falling object or marble 62.

The embodiments described and variations thereof may provide for a very precise rebounding device that can be counted on to consistently redirect an incoming object to a selected location. For example, with reference to FIG. 3A, an marble was placed in the upper most cube and allowed to roll down to the exit point 54 and fall to the accessory 100 along a path similar to the incoming trajectory. It is noted that some variation from the trajectory shown was noted due to variations in how the marble exited the cube at 54. Upon contacting the accessory 100, the marble was redirected along a path similar to the outgoing trajectory shown and causing the marble to land in one of the cubes 60*a*-60*d*. Again, some variation from the trajectory shown was noted due to the variations in the incoming trajectory previously noted. For purposes of analysis and/or comparison, the distance that the marble dropped from exit point 54 to the accessory was about 5 inches and the horizontal distance traveled from the accessory to the cubes 60*a*-60*d* was about 7-8 inches. In addition, the angle of the accessory in this particular example is approximately 10 to 20 degrees from horizontal.

Using the above arrangement, a series of 10 marbles were run through the system. Given the variations in the incoming trajectory discussed, the accessory consistently directed each of the 10 marbles into one of cubes 60*a*-60*d*, which reflect approximately an area of about 3 inches by 3 inches. Upon re-entering the modular pathway apparatus, the marbles then continued along a path through the apparatus. It is to be appreciated that the landing area shown (i.e., cubes 60*a*-60*d*) may be replaced with a different arrangement of cubes or another accessory such as a rebounding device or trampoline, a basket, a shoot, a funnel, a cup, a backboard or flatboard, or another type of accessory. However, the consistency of the accessory 100 may allow the user to have confidence that the accessory 100 will function consistently with the system they design and build.

Referring now to FIGS. 14-17, an additional embodiment of an accessory 500 is shown. This embodiment may include a rebounding portion 502, an adjustment portion 506, a base 504, and a connector 526. In contrast to the previously described embodiment, the adjustment portion of the present embodiment may include two rotational degrees of freedom in lieu of three. Otherwise, the several aspects of the accessory 500 may be configured for similar functions and purposes, but same, similar, or differing details may be provided for such functions and purposes.

As shown, the rebounding portion 502 may include a frame or stretcher portion 508 in the form of a dish or cup, for example, and it may include a resilient member 510 in the form of a stretchable membrane. As shown in FIG. 15, the stretchable membrane 510 may be stretched over a stretcher ring 552 and may be secured in place on the stretcher ring 552 by a retainer ring 554. The stretcher ring 552 and retainer ring 554 may pinch the membrane therebetween and secure the membrane in a taut condition. The stretcher and retainer ring 552/554 assembly may then be secured to the dish or cup by slipping the assembly down over the rim 556 of the dish or cup where a retainer hook 558 may elastically deflect and snap below the rim 556 to secure the assembly in place. Still other approaches to retaining the membrane in a taut condition may be employed.

The adjustment portion 506 may include a curved structure arranged along the curved profile of the bottom of the dish or cup. The curved structure may include a blade portion 560 and a bulb portion 562. The blade portion 560 may track along the bottom of the cup or dish and may include an attachment edge 564 that is secured to the bottom of the dish or cup and a free edge 566 opposite the attachment to the dish or cup. The free edge 566 may be a curved edge that is substantially concentric with the bottom of the dish or cup and may have a similar included angle as the dish or cup. As shown in FIG. 15, the included angle of the blade 560 may be slightly less than the dish or cup causing the ends of the blade 560 to be slightly short of the edges of the dish or cup and providing clearance near the peripheral edge of the dish or cup for attachment of the stretcher and retainer rings 552/554 for the membrane. The bulb portion 562 of the curved structure may include a round cross-section or other shaped cross-section that is substantially constant along the length of the bottom of the blade 560.

The base 504 of the accessory 500 may include a pedestal 518 and an anchor portion 520. The pedestal portion 518 may be configured to support the rebounding portion 502 and may be further configured to allow the rebounding portion 502 to pivot about a horizontal axis 628 substantially perpendicular to a longitudinal axis 626 of the pedestal 518. The pedestal portion 518 may also be configured to swivel relative to the anchor portion 520 such that the rebounding portion 502 may be rotated. Like the above embodiment, the longitudinal axis 532 of the rebounding portion 502 when arranged in a flat condition may be offset and substantially parallel to the longitudinal axis 626 of the pedestal 518. Accordingly, rotation of the pedestal portion 518 may allow the center of the rebounding portion 502 to be adjusted.

As shown in FIGS. 16 and 17, the pedestal portion 518 may include a seat portion 522 at a top end thereof for seated arrangement of the dish or cup. The seat 522 may include a radiused or otherwise curved seat that matches the curvature of the dish or cup and allows the dish or cup to slidingly propagate across the pedestal 518 while pivoting. The pedestal 518 may also include a vertical slot 596 and a keyhole 598 sized and arranged for slidingly receiving and guiding the blade 560 and bulb 562 of the adjustment portion 506. As such, a user may grasp the bulb 562 and/or blade 560 portion outside the pedestal 518 and push or pull the rebounding portion 502 across the seat of the pedestal 518 thereby pivoting the rebounding portion according to the curvature of the bottom of the dish or cup and the curvature of the seat 522. The vertical slot 596 and/or keyhole 598 may frictionally engage the blade 560 and/or bulb 562 such that when a position is selected for the rebounding portion 502, the rebounding portion 502 may remain positioned as desired until some force is applied to adjustment portion 506 to reposition the rebounding portion 502.

The pedestal portion 518 may engage the anchor portion 520 and be configured to swivel relative thereto. As shown in FIG. 15, the pedestal portion 518 may extend through a ring portion of the anchor portion 520 and may include a retention lip 612 on a bottom portion thereof such that when the pedestal 518 is inserted through the ring portion, the retention lips 612 may deflect to allow the pedestal 518 to pass therethrough and once all the way through, the retention lips 612 may spring outward causing the retention lips 612 to engage the ring portion and prevent separation of the pedestal 518 and ring portion while allowing relative rotation.

The anchor portion 520 may include one or more legs 620 configured for engaging a modular member 52. For example, as shown in FIG. 14, the anchor portion 520 may include four legs 620 having a foot print slightly smaller than the inside dimensions of a modular member 52 and configured for a friction fit within the modular member 52. As such, the anchor portion 520 may be set atop a modular member 52 and the legs 620 may extend downward into the modular member 52 along the vertically extending internal corners of the modular member 52 and creating a friction fit between the anchor portion 520 and the modular member 52.

The embodiment described in FIGS. 14-17 may include two rotational degrees of freedom. That is, the pedestal 518 may be rotated about its vertical longitudinal axis 626 allowing the center of the rebounding portion 502 to be adjusted. In addition, the rebounding portion 502 may be pivoted by sliding the blade/bulb 560/562 through the pedestal 518 and along the arc defined by the shaped of the cup/dish and the arc of the blade/bulb 560/562 passing through the pedestal 518.

Although the invention has been described with reference to various embodiments, persons skilled in the art will recognize that changes may be made in form and detail without departing from the spirit and scope of the invention. For example, while the frame or stretcher portion of the accessory has been described as a shell-like device such as a dish or bowl, a frame-like structure with struts and ties, for example, may also be provided. Similarly, other portions of the accessory may be provided with other structural formations.

What is claimed is:

1. An accessory for a toy or game, the accessory comprising:

a base having a peripheral housing establishing a vertical axis of the base;

a plug rotatably attached to the base and providing for three degrees of rotational freedom relative to the base;

a rebounding surface having a center and configured for rebounding a falling object; and a frame holding the rebounding surface and fixedly attached to the plug;

wherein:

when the rebounding surface is horizontally oriented in an upward facing orientation generally perpendicular to the vertical axis of the base:

the center of the rebounding surface is horizontally offset from a vertical axis of the plug, the vertical axis of the plug extending generally parallel to the vertical axis of the base; and the rebounding surface can be rotated 360 degrees around the vertical axis of the plug; and when the rebounding surface is aligned above the plug such that the center of the rebounding surface is positioned along the vertical axis of the plug:

the rebounding surface is oriented at an angle to the vertical axis of the plug; and the rebounding surface can be rotated 360 degrees around the vertical axis of the plug.

2. The accessory of claim 1, wherein the rebounding surface is defined by a surface of a resilient member stretched over the frame.

3. The accessory of claim 2, wherein the resilient member is arranged in a taut condition on the frame and is secured in the taut position by a cinching device.

4. The accessory of claim 3, further comprising a cover having a peripheral rim that surrounds the rebounding surface and is arranged slightly above the rebounding surface.

5. The accessory of claim 1, wherein the base includes a top and a biasing mechanism and the plug is arranged in the base and biased against the top by a biasing force of the biasing mechanism.

6. The accessory of claim 5, wherein the top includes an opening having a retainer arranged around a perimeter thereof, the retainer configured to retain the plug in the base against the biasing force.

7. The accessory of claim 6, wherein the base further comprises a seat arranged between the biasing mechanism and the plug.

8. The accessory of claim 7, wherein the retainer and the seat define a spherical interface for frictionally engaging the plug.

9. The accessory of claim 1, wherein the angle ranges from approximately 15 degrees to 30 degrees from a horizontal plane that is perpendicular to the vertical axis of the base.

10. The accessory of claim 9, wherein the angle is approximately 22.5 degrees from a horizontal plane that is perpendicular to the vertical axis of the base.

* * * * *